US010807818B2

(12) United States Patent
Chiba

(10) Patent No.: US 10,807,818 B2
(45) Date of Patent: Oct. 20, 2020

(54) SHEET FEEDING APPARATUS AND IMAGE FORMING APPARATUS

(71) Applicant: CANON KABUSHIKI KAISHA, Tokyo (JP)

(72) Inventor: Yoshinao Chiba, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 61 days.

(21) Appl. No.: 16/142,186

(22) Filed: Sep. 26, 2018

(65) Prior Publication Data

US 2019/0119058 A1 Apr. 25, 2019

(30) Foreign Application Priority Data

Oct. 24, 2017 (JP) ..... 2017-205560

(51) Int. Cl.

*B65H 7/02* (2006.01)
*B65H 3/06* (2006.01)
*B65H 3/52* (2006.01)

(52) U.S. Cl.

CPC ..... *B65H 3/0669* (2013.01); *B65H 3/0684* (2013.01); *B65H 3/5215* (2013.01); *B65H 7/02* (2013.01); *B65H 2513/50* (2013.01); *B65H 2515/32* (2013.01); *B65H 2515/704* (2013.01); *B65H 2515/708* (2013.01); *B65H 2701/1311* (2013.01); *B65H 2701/1313* (2013.01); *B65H 2801/06* (2013.01)

(58) Field of Classification Search

CPC ... B65H 7/00; B65H 7/06; B65H 7/02; B65H 3/0669

See application file for complete search history.

(56) References Cited

U.S. PATENT DOCUMENTS 6,726,199 B2 * 4/2004 Ina ..... B65H 15/00 271/186
6,786,481 B2 * 9/2004 Kawai ..... B65H 3/0661 271/109
8,651,477 B2 2/2014 Chiba
9,085,179 B2 * 7/2015 Noguchi ..... B41J 15/04
9,102,488 B2 8/2015 Chiba et al.

(Continued)

FOREIGN PATENT DOCUMENTS

JP H11-223969 A 8/1999
JP 2011133716 A * 7/2011

(Continued)

*Primary Examiner* — Howard J Sanders
(74) *Attorney, Agent, or Firm* — Venable LLP

(57) ABSTRACT

A sheet feeding apparatus includes a sheet stacking portion, and a sheet feeding unit having a rotary feeding member and a separation member defining a nip portion together with the rotary feeding member, with the nip portion separating the sheet fed by the rotary feeding member from another sheet. A load detecting unit detects a conveyance load acting on the sheet feeding unit while feeding the sheet, and a control unit controls the sheet feeding unit to start to feed a second sheet succeeding to a first sheet at a first timing in a case where the conveyance load detected while feeding the first sheet is less than a threshold value, and starts to feed the second sheet at a second timing which is later than the first timing in a case where the conveyance load detected while feeding the first sheet exceeds the threshold value.

13 Claims, 16 Drawing Sheets

(56) References Cited

U.S. PATENT DOCUMENTS

| | | | | |
|---|---|---|---|---|
| 9,227,806 | B2 | 1/2016 | Chiba | |
| 9,254,973 | B2 | 2/2016 | Ishida et al. | |
| 9,327,926 | B2 | 5/2016 | Chiba | |
| 9,567,172 | B2 | 2/2017 | Chiba et al. | |
| 2013/0241145 | A1* | 9/2013 | Yasukawa | B65H 3/5261 271/272 |
| 2019/0100393 | A1* | 4/2019 | Shiozawa | B65H 7/02 |
| 2019/0104228 | A1* | 4/2019 | Arimori | H04N 1/00602 |
| 2019/0210826 | A1* | 7/2019 | Beppu | B65H 7/06 |

FOREIGN PATENT DOCUMENTS

| | | | | |
|---|---|---|---|---|
| JP | 2012025503 | A | * | 2/2012 |
| JP | 2013151340 | A | * | 8/2013 |

* cited by examiner

SHEET FEEDING APPARATUS AND IMAGE FORMING APPARATUS

BACKGROUND OF THE INVENTION

Field of the Invention

The present invention relates to a sheet feeding apparatus configured to feed a sheet and to an image forming apparatus including the same.

Description of the Related Art

In general, an image forming apparatus such as a printer, a facsimile machine and a copier includes a sheet feeding apparatus configured to feed a sheet. Hitherto, Japanese Unexamined Patent Application Publication No. 11-223969 for example has proposed a sheet feeding apparatus including a delivery roll configured to deliver a sheet stacked on a tray and a feed roll and a retard roll configured to separate the sheet delivered by the delivery roll from another sheet. However, in a case where the sheet cannot be separated by a separation nip defined by the feed roll and the retard roll, a position of a leading edge of the sheet varies while feeding the sheet.

A pre-feed sensor configured to detect a leading edge of a sheet is provided downstream in a sheet feeding direction of the separation nip and can detect a leading edge of a succeeding sheet fed following to a preceding sheet. In a case where the pre-feed sensor is ON before starting to feed a sheet, the sheet feeding apparatus delays feed starting timing of the sheet more than a normal case to prevent the succeeding sheet from approaching too much to the preceding sheet.

While Japanese Unexamined Patent Application Publication No. 11-223969 describes no specific configuration of the pre-feed sensor, there is known a sensor including a flag that swings by being pressed by a sheet and a photo sensor that outputs a detection signal in response to a position of the flag as a sensor that detects a leading edge of a sheet in general.

However, an optical photo sensor has had an error of about ±5 mm at a boundary position of ON/OFF of a photodetector and has had no favorable sheet detection accuracy. Then, it has been necessary to provide a margin in an interval between a preceding sheet and a succeeding sheet (referred to as a 'sheet interval' hereinafter) to widen the sheet interval by the variation of the detection accuracy of the photo sensor.

SUMMARY OF THE INVENTION

According to a first aspect of the present invention, a sheet feeding apparatus includes a sheet stacking portion on which a sheet is stacked, a sheet feeding unit including a rotary feeding member configured to come into contact with the sheet and to rotate, and a separation member configured to define a nip portion together with the rotary feeding member, the nip portion separating the sheet fed by the rotary feeding member from another sheet, the sheet feeding unit executing a feeding operation of feeding the sheet stacked on the sheet stacking portion, a load detecting unit configured to detect a conveyance load acting on the sheet feeding unit while feeding the sheet by the sheet feeding unit, a control unit configured to control the sheet feeding unit such that the sheet feeding unit executes the feeding operation to a second sheet succeeding to a first sheet with a first feeding interval or with a second feeding interval which is longer than the first feeding interval in response to a detection result of the load detecting unit while feeding the first sheet, wherein each of the first and second feeding intervals is defined by a time interval from starting to feed the first sheet until starting to feed the second sheet.

According to a second aspect of the present invention, a sheet feeding apparatus includes a sheet stacking portion on which a sheet is stacked, a sheet feeding unit including a rotary feeding member configured to come into contact with the sheet and to rotate, and a separation member configured to define a nip portion together with the rotary feeding member, the nip portion separating the sheet fed by the rotary feeding member from another sheet, the sheet feeding unit executing a feeding operation of feeding the sheet stacked on the sheet stacking portion, and a load detecting unit configured to detect a conveyance load acting on the sheet feeding unit while feeding the sheet by the sheet feeding unit, wherein the sheet feeding unit executes the feeding operation to a second sheet succeeding to a first sheet with a first feeding speed or with a second feeding speed which is slower than the first feeding speed in response to a detection result of the load detecting unit while feeding the first sheet.

Further features of the present invention will become apparent from the following description of exemplary embodiments with reference to the attached drawings.

DESCRIPTION OF THE EMBODIMENTS

First Embodiment

A first embodiment will be described below with reference to the drawings. It is noted that positional relationships of up and down, right and left and front and rear will be represented based on a state in which an image forming apparatus is seen from a front side, i.e., in a point of view of FIG. 1.

Outline of Structure of Printer

Figure 1:
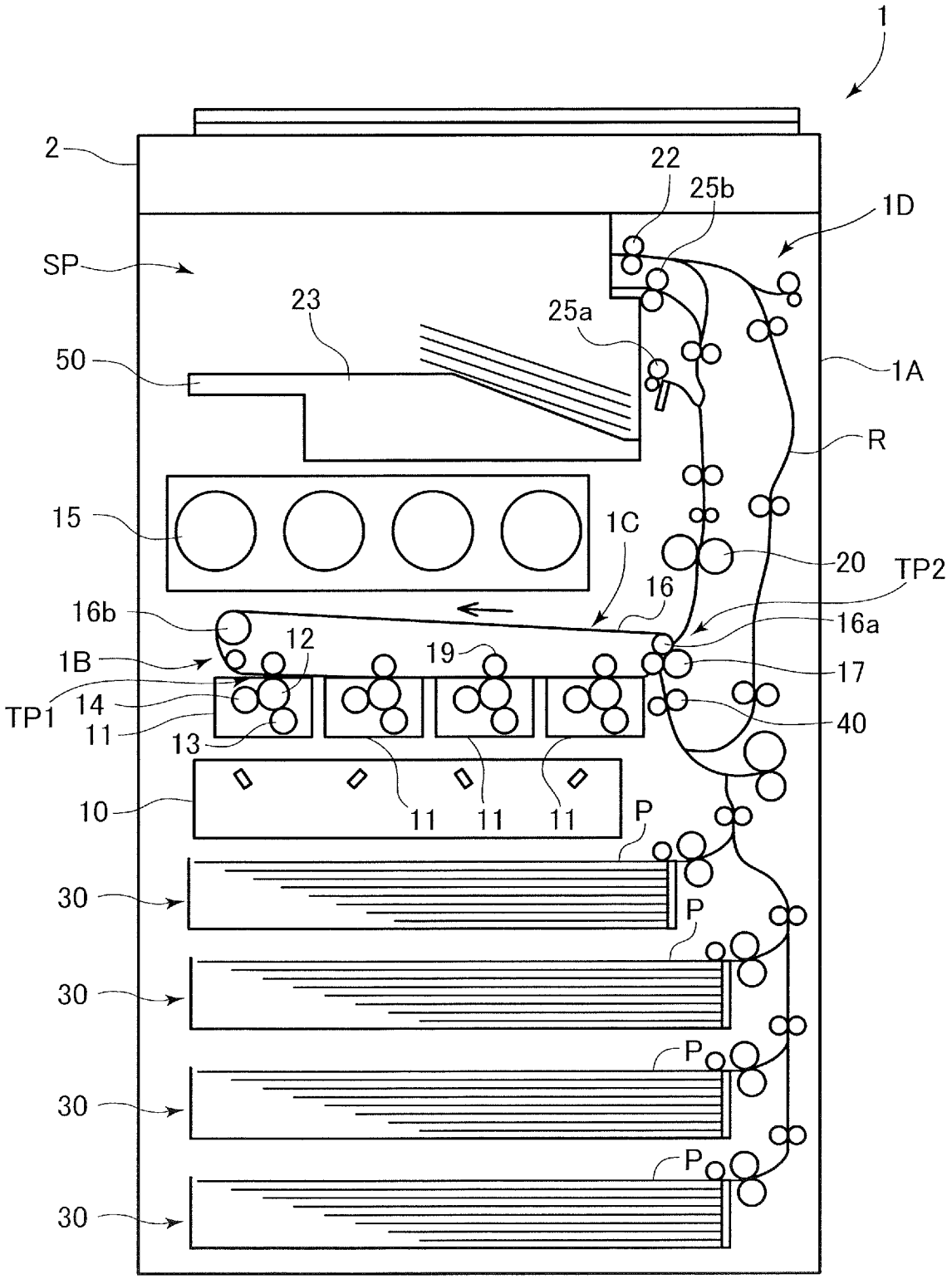
FIG. 1 is an over-all schematic diagram illustrating a configuration of a printer of a first embodiment.

A printer 1 of the present embodiment is an electrophotographic full-color laser beam printer. As illustrated in FIG. 1, the printer 1 includes a printer body 1A, i.e., an apparatus body, and a reading apparatus 2 provided above the printer body 1A and configured to read image data of a document.

The printer body 1A includes an image forming portion 1B configured to form an image on a sheet P, and a fixing portion 20 configured to fix the image onto the sheet P and others. Formed between the reading apparatus 2 and the printer body 1A is a discharge space SP in which a discharge tray 23 is provided. The sheet P discharged out of the printer body 1A is stacked on the discharge tray 23. The printer body 1A also includes a plurality (four in the present embodiment) of sheet feeding apparatuses 30 configured to feed the sheet P to the image forming portion 1B.

The image forming portion 1B is a so-called four-drum full-color image forming unit including a laser scanner 10, four process cartridges 11 and an intermediate transfer unit 1C. These process cartridges form toner images of respective colors of yellow (Y), magenta (M), cyan (C) and black (K). Each process cartridge 11 includes a photosensitive drum 12, a charger 13, a developer 14 and a cleaner (not illustrated). Toner cartridges 15 configured to store toners of the respective colors are removably attached to the printer body 1A above the image forming portion 1B.

An intermediate transfer unit 1C includes an intermediate transfer belt 16 wrapped around a driving roller 16*a*, a tension roller 16*b* and others and disposed above the four process cartridges 11. The intermediate transfer belt 16 is disposed so as to come into contact with the photosensitive drums 12 of the respective process cartridges 11 and is rotationally driven counterclockwise by the driving roller 16*a* driven by a driving unit knot illustrated). The intermediate transfer unit 1C includes four primary transfer rollers 19 being in contact with an inner circumferential surface of the intermediate transfer belt 16 at positions facing to the respective photosensitive drums 12 and defining primary transfer portions TP1 as nip portions between the intermediate transfer belt 16 and the photosensitive drums 12. The image forming portion 1B also includes a secondary transfer roller 17 being in contact with an outer circumferential surface of the intermediate transfer belt 16 at a position facing the driving roller 16*a*. A secondary transfer portion TP2 where the toner images borne on the intermediate transfer belt 16 are transferred onto the sheet P is formed as a nip portion between the secondary transfer roller 17 and the intermediate transfer belt 16.

In the respective process cartridges 11 constructed as described above, the toner images of the respective colors negatively charged are formed on surfaces of the photosensitive drums 12 by toners supplied from the developer 14 after when electrostatic latent images are drawn by the laser scanner 10. These toner images are superimposed and transferred sequentially onto the intermediate transfer belt 16 at the respective primary transfer portions TP1 by positive transfer bias voltage applied to the primary transfer roller 19, and a full-color toner image is thus formed on the intermediate transfer belt 16.

In parallel with such image forming process, the sheet P fed from the sheet feeding apparatus 30 is conveyed toward a registration roller pair 40 such that a skew thereof is corrected by the registration roller pair 40. The registration roller pair 40 conveys the sheet P to the secondary transfer portion TP2 with timing synchronized with transfer timing of the full-color toner image formed on the intermediate transfer belt 16. Because the positive transfer bias voltage is applied to the secondary transfer roller 17, the toner image borne on the intermediate transfer belt 16 is secondarily transferred onto the sheet P at the secondary transfer portion TP2.

The sheet P on which the toner image has been transferred is heated and pressurized in the fixing portion 20 to fix the color image on the sheet P. The sheet P on which the image has been fixed is discharged and is stacked on the discharge tray 23 by a first or second sheet discharge roller pair 25*a* or 25*b*. It is noted that in a case where images are to be formed on both faces of the sheet P, the sheet P is switched back by a reverse conveyance roller pair 22 rotatable normally and reversely after passing through the fixing portion 20. Then, the sheet P is conveyed again to the secondary transfer portion TP2 through a re-conveyance path R to form an image on a back face thereof.

Sheet Feeding Apparatus

Figure 2A:
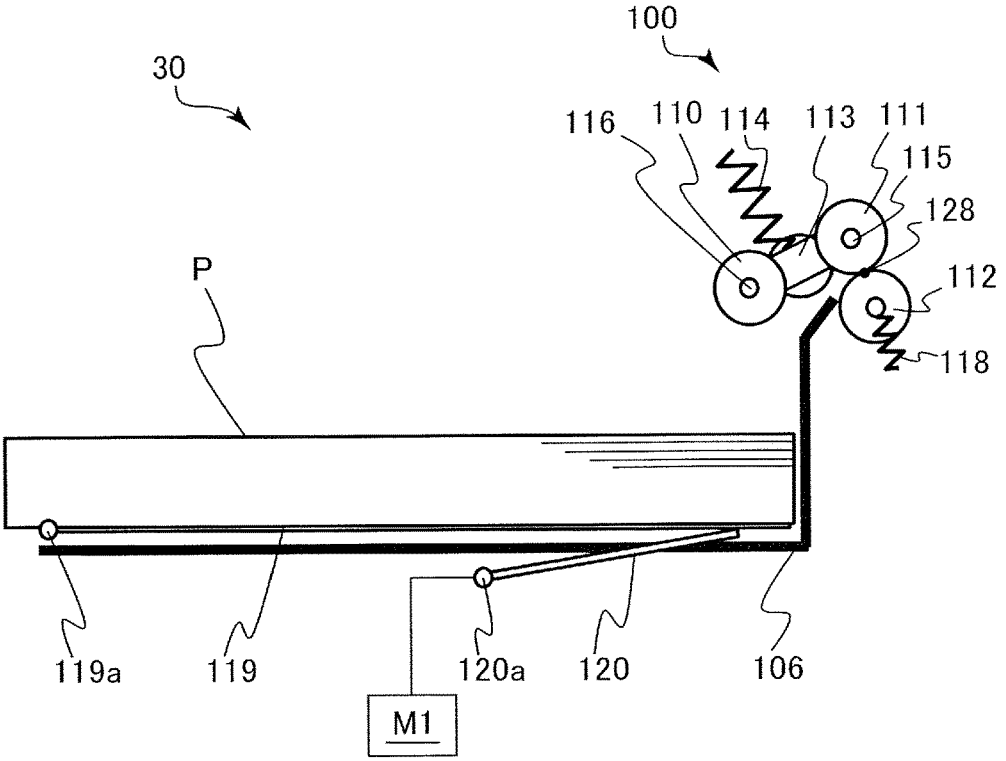
FIG. 2A is a side view illustrating a sheet feeding apparatus in a state in which a sheet supporting portion is located at a standby position.
Figure 2B:
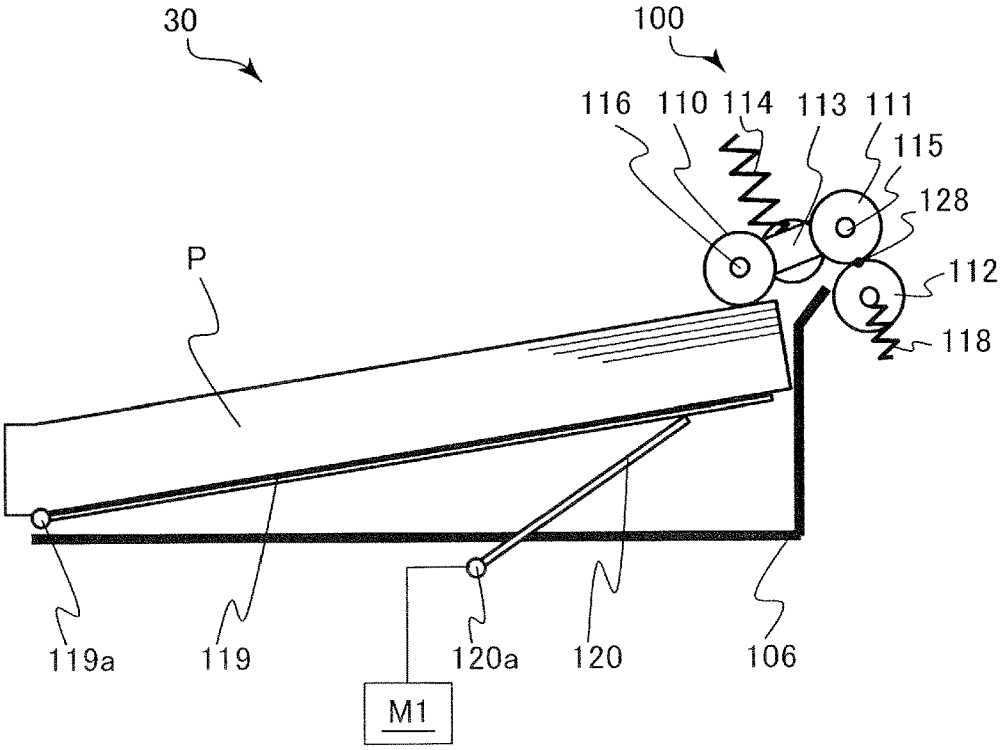
FIG. 2B is a side view illustrating the sheet feeding apparatus in a state in which the sheet supporting portion is located at a feed position.

As illustrated in FIGS. 2A and 2B, the sheet feeding apparatus 30 includes a cassette 106 that can be attached/detached to/from the printer body 1A (see FIG. 1) and a sheet feed portion 100 as a sheet feed unit feeding a sheet stored in the cassette 106. The cassette 106 supports a sheet supporting plate 119 turnably centering on a rotary shaft 119*a* by supporting by a lift plate 120 turnably centering on a rotary shaft 120*a*. The lift plate 120 is disposed under the sheet supporting plate 119 and is turn up and down by a lifting motor M1. The sheet supporting plate 119 serving as a sheet stacking portion is lifted from a standby position as illustrated in FIG. 2A to a feed position as illustrated in FIG. 2B by being pushed from underneath by the lift plate 120. Then, when the sheet supporting plate 119 is positioned at the feed position, the sheet P stacked on the sheet supporting plate 119 comes in to contact with a pickup roller 110 of the sheet feed portion 100.

Figure 3:
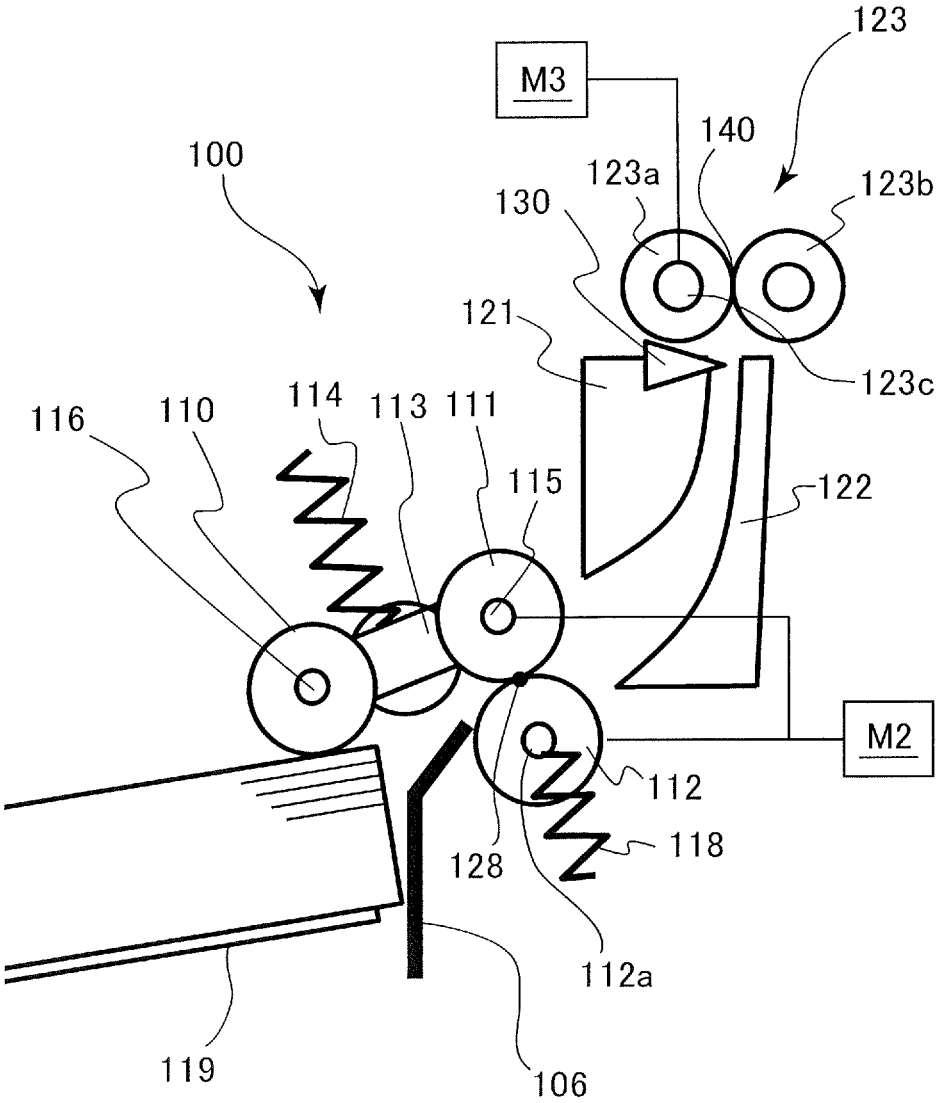
FIG. 3 is a side view illustrating a feed portion of the sheet feeding apparatus.
Figure 4:
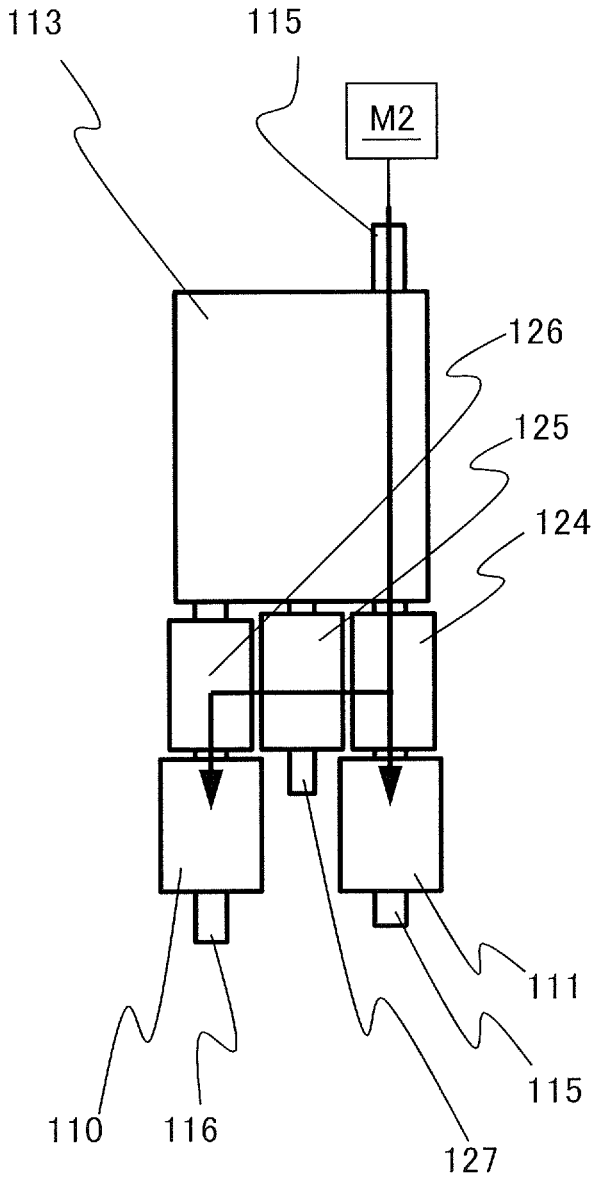
FIG. 4 illustrates a drive transmission mechanism of a pickup roller and a feed roller.

As illustrated in FIGS. 3 and 4, the sheet feed portion 100 includes the pickup roller 110 configured to feed the sheet stacked on the sheet supporting plate 119, and a feed roller 111 and a retard roller 112 configured to separate the sheet fed by the pickup roller 110 from another sheet. The feed roller 111 serving as a rotary feeding member is rotatably supported by a feed roller shaft 115 driven by a feed motor M2, and an elevating plate 113 is swingably supported by the feed roller shaft 115 serving as a first rotary shaft.

The elevating plate 113 rotatably supports an idler shaft 127 and a pickup roller shaft 116. The pickup roller 110 serving as an upstream rotary member is rotatably supported by the pickup roller shaft 116. Still further, a feed gear 124, an idler gear 125 and a pickup gear 126 are mounted to the feed roller shaft 115, the idler shaft 127 and the pickup roller shaft 116, respectively. Rotation of the feed roller shaft 115 driven by the feed motor M2 is transmitted to the pickup roller shaft 116, by which the pickup roller 110 is supported, through the feed gear 124, the idler gear 125 and the pickup gear 126.

The elevating plate 113 is urged downward by a pickup spring 114, and the pickup roller 110 comes into contact with a sheet by a predetermined feed pressure by urging force of the pickup spring 114. The retard roller 112 serving as a separation member is rotatably supported by the retard shaft 112*a* through a torque limiter not illustrated and is urged toward the feed roller 111 by a retard spring 118. Thereby, the retard roller 112 is in pressure contact with the feed roller 111 at a separation nip 128 serving as a nip portion. Still further, driving force from a feed motor M2 is transmitted to the retard shaft 112*a* through a drive transmission mechanism (not illustrated), and the retard roller 112 tries to rotate in a direction of returning a sheet to the cassette 106 when the feed motor M2 is driven.

An inner guide 121, an outer guide 122 and a conveyance roller pair 123 are disposed downstream in the sheet feeding direction of the feed roller 111 and the retard roller 112. The conveyance roller pair 123 includes a driving roller 123*a* serving as a rotary conveyance member and a driven roller 123*b*. The driving roller 123*a* is supported rotatably by a rotary shaft 123*c* serving as a second rotary shaft. Then, as the rotary shaft 123*c* is driven by a conveyance motor M3, the driving roller 123*a* rotates and the driven roller 123*b* rotates following the driving roller 123*a*. A conveyance sensor 130 serving as a sheet detection unit configured to detect a sheet being conveyed is disposed upstream in the sheet feeding direction of a conveyance nip 140 defined by the driving roller 123*a* and the driven roller 123*b* and downstream of the separation nip 128.

Sheet Feeding Operation

When a sheet feeding job is inputted or the cassette 106 is inserted into the printer body 1A, the lifting motor M1 starts to drive such that the sheet supporting plate 119 is lifted. A position of an uppermost sheet stacked on the sheet supporting plate 119 is detected by a sensor not illustrated, and the sheet supporting plate 119 stops when the sheet supporting plate 119 is positioned at the feed position as illustrated in FIG. 2B.

In this state, the feed motor M2 serving as a first driving source and the conveyance motor M3 serving as a second driving source drive such that the pickup roller 110 feeds the sheet stacked on the sheet supporting plate 119. The sheet fed by the pickup roller 110 is separated from another sheet at the separation nip 128. More specifically, when only one sheet is fed to the separation nip 128, a torque limiter not illustrated and provided between the retard shaft 112*a* and the retard roller 112 idles and the retard roller 112 rotates following the feed roller 111. When two more sheets are fed to the separation nip 128, the retard roller 112 rotates in the direction of returning the sheet to the cassette 106 to return the second sheet and thereafter to the cassette 106. It is noted that no driving force may be inputted to the retard roller 112 or a separation pad may be provided instead of the retard roller 112.

The sheet separated from another sheet by the separation nip 128 is guided to the conveyance roller pair 123 by the inner and outer guides 121 and 122 and is conveyed downstream in the sheet feeding direction by the conveyance nip 140 of the conveyance roller pair 123. It is noted that although conveyance speeds of the sheet at the pickup roller 110, the separation nip 128 and the conveyance nip 140 are set to be equal in the present embodiment, the present disclosure is not limited to such arrangement. For instance, the conveyance speed of the conveyance nip 140 may be set to be earlier than the conveyance speed of the pickup roller 110 and the separation nip 128 to improve productivity. In this case, a one-way clutch that disconnects power transmitted from the sheet conveyed by the conveyance nip 140 is built in the pickup roller 110 and the feed roller 111.

Control Block

Figure 5:
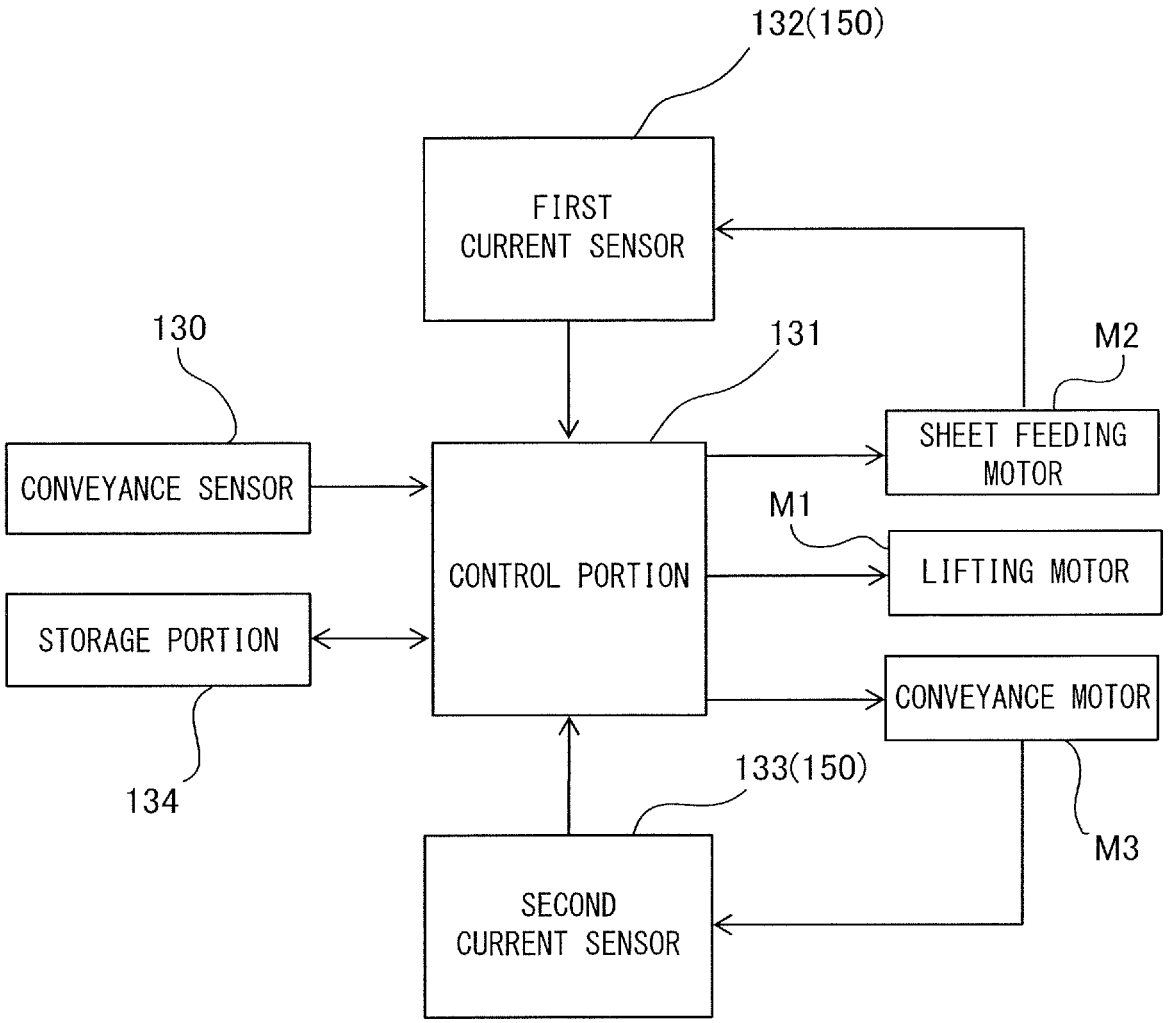
FIG. 5 is a block diagram of a control unit of the first embodiment.

FIG. 5 is a control block diagram of a control unit 131 of the present embodiment. A conveyance sensor 130, a first current sensor 132 and a second current sensor 133 are connected to an input side of the control unit 131, and the lifting motor M1, the feed motor M2 and the conveyance motor M3 are connected to an output side of the control unit 131. The first current sensor 132 detects a current flowing through the feed motor M2, and a second current sensor 133 detects a current flowing through the conveyance motor M3. That is, these first and second current sensors 132 and 133 compose a load detecting unit 150 that detects currents flowing through the feed motor M2 and the conveyance motor M3 that are parameters corresponding to a conveyance load acting on the sheet feed portion 100. The greater the currents flowing though the feed motor M2 and the conveyance motor M3, the greater the conveyance load acting on the sheet feed portion 100 is. The control unit 131 is also connected with a storage portion 134 that stores detection results of the first and second current sensors 132 and 133.

In consecutively feeding sheets by the sheet feed portion 100, a feeding operation of a succeeding sheet is started after an elapse of a predetermined time corresponding to a sheet size from feed starting timing of a preceding sheet. At this time, it is necessary to keep an interval of more than a predetermined distance between a trailing edge of the preceding sheet and a leading edge of the succeeding sheet (referred to as a 'sheet interval' hereinafter). If the sheet interval is too narrow, there is a case where the conveyance sensor 130 is not turned OFF even if the preceding sheet has passed through and timing when the succeeding sheet arrives at the conveyance sensor 130 becomes unclear. Still further, if the conveyance of the preceding sheet is belated, the preceding sheet and the succeeding sheet overlap with each other, possibly causing a jam of the sheet.

Therefore, although it is necessary to set the sheet interval with a margin of certain degree, if the sheet interval is too long, it takes time to execute a job of consecutively feeding a plurality of sheets, thus dropping productivity. Although it is possible to shorten the time required for the job by increasing sheet conveyance speed even if the sheet interval is set long, there is a possibility that noise of the apparatus increases, giving a user a feeling of discomfort. Accordingly, it is preferable to set the sheet interval as short as possible within a range of causing no problem.

Method for Discriminating Conveyance State

Figure 6A:
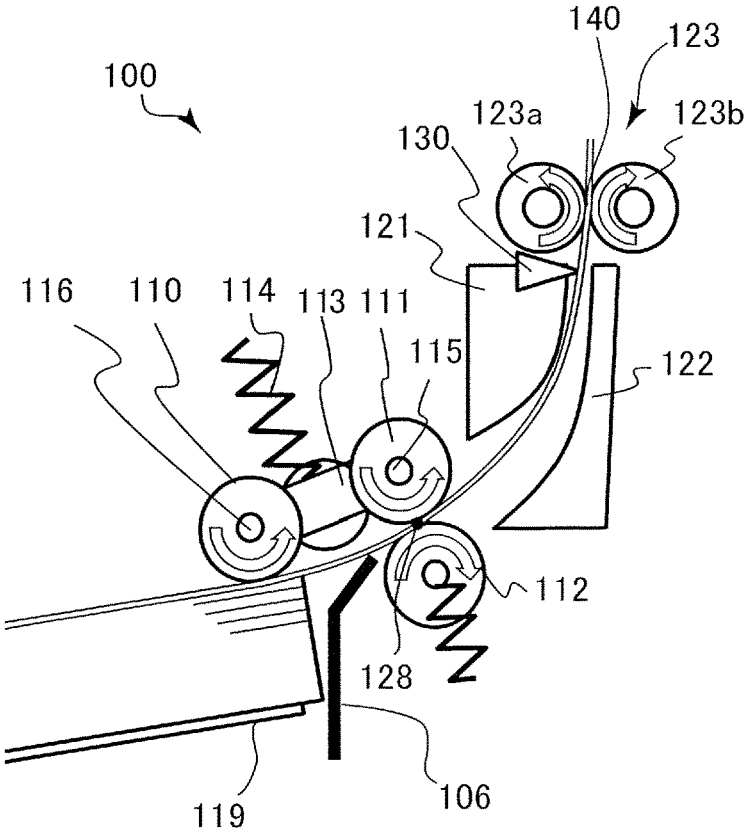
FIG. 6A is a side view illustrating a separation nip in a one-sheet conveyance state.

Next, a method for discriminating a conveyance state of a sheet in the separation nip 128 will be described. A state in which only one sheet is fed while being nipped by the separation nip 128 as illustrated in FIG. 6A will be referred to as a one-sheet conveyance state hereinafter. A conveyance load R1 generated in the sheet feed portion 100 in the one-sheet conveyance state can be represented by the following expression:

$$R1=\mu p\times Na+Ft+Fg \quad (1)$$

where, μp is a coefficient of friction among sheets,

Na is an abutting force of the pickup roller 110 against the sheet,

Ft is a blocking force generated by the torque limiter, and

Fg is a resistance force generated by friction between the inner and outer guides 121 and 122 and the sheet.

Figure 6B:
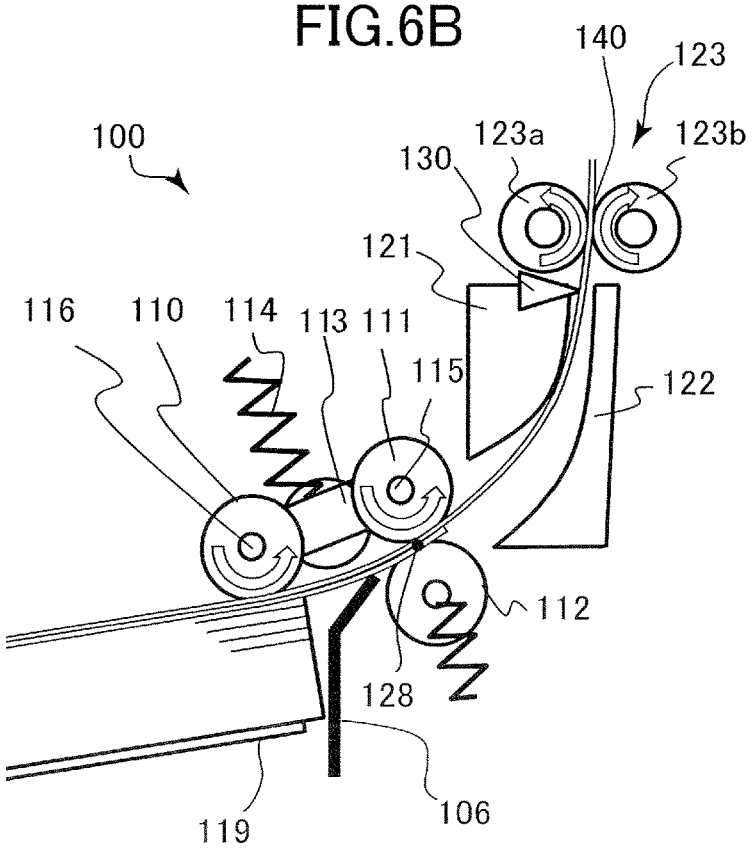
FIG. 6B is a side view illustrating the separation nip in a separation state.

Meanwhile, a state in which a plurality of sheets is nipped by the separation nip 128 as illustrated in FIG. 6B will be referred to as a 'separation state' hereinafter. A conveyance load R2 generated in the sheet feed portion 100 in the separation state can be represented by the following expression:

$$R2=\mu p\times Na+\mu p\times Nb+Fg \quad (2)$$

where, Nb is an abutting force of the feed roller 111 and the retard roller 112.

Still further, the following expression holds in a state in which the plurality of sheets is separated from another sheet by the retard roller 112 as illustrated in FIG. 6B:

$$Ft>=\mu p\times Nb \quad (3)$$

Accordingly, the following expression holds from the expressions (1) through (3):

$$R1>R2 \quad (4)$$

Then if μp=0.4, Ft=300 [gf] and Nb=300 [gf], $$R1-R2=180\ [gf]$$

That is, the conveyance load generated in the sheet feed portion 100 in the separation state is lower by 180 [gf] as compared to that in the one-sheet conveyance state. Accordingly, it is possible to discriminate the one-sheet conveyance state and the separation state by detecting this conveyance load. In the present embodiment, the detection of the conveyance load is carried out by detecting a load torque acting on the feed motor M2 or the conveyance motor M3.

Figure 7:
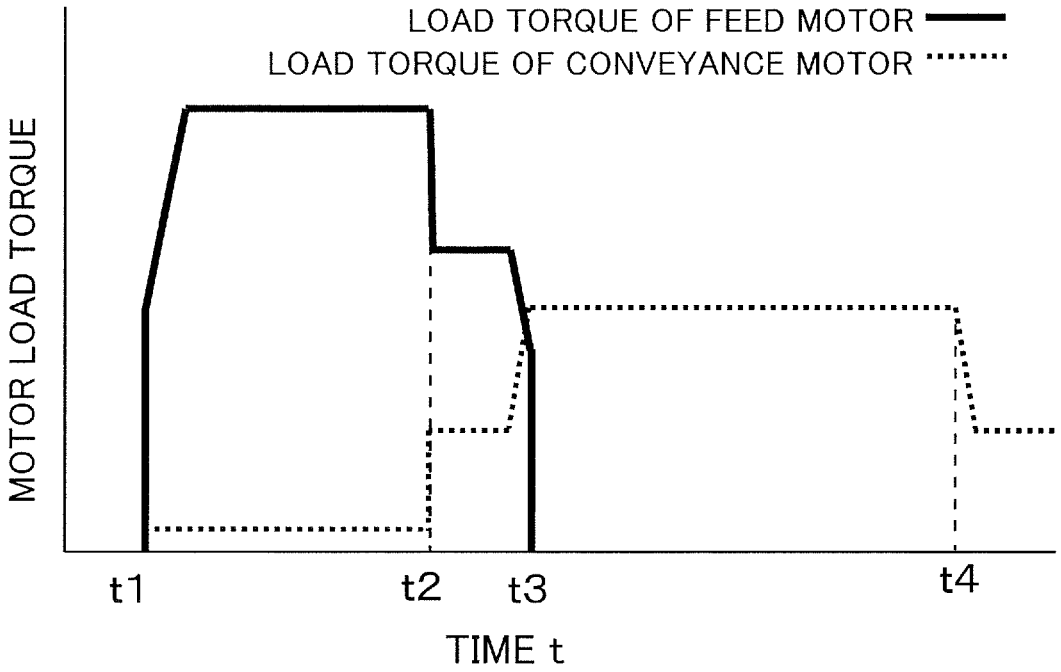
FIG. 7 is a graph indicating a transition of a load torque acting on a feed motor and a conveyance motor.

FIG. 7 is a graph indicating a transition of the load torque acting on the feed motor M2 and the conveyance motor M3 in the one-sheet conveyance state. Then, time t1 is timing when the feed motor M2 and the conveyance motor M3 are started to be driven such that the sheet feeding operation of the sheet feed portion 100 is started, and time t2 is timing when a leading edge of the sheet has arrived at the conveyance nip 140. Time t3 is timing when the drive of the feed motor M2 is turned OFF and time t4 is timing when the leading edge of the sheet has arrived at a roller pair next to the conveyance roller pair 123.

Because the sheet is conveyed by the pickup roller 110 and the feed roller 111 in a section from the time t1 to the time t2, the feed motor M2 receives all of the conveyance load generated in the sheet feed portion 100. It is noted that while the conveyance motor M3 generates a slight load torque during the time t1 to the time t2, it is because the conveyance roller pair 123 rotates before the sheet arrives at the conveyance nip 140.

When the leading edge of the sheet arrives at the conveyance nip 140 at the timing of the time t2, the conveyance load is distributed to the feed motor M2 and the conveyance motor M3. Due to that, the load torque of the feed motor M2 drops and the load torque of the conveyance motor M3 rises. After that, the leading edge of the sheet arrives at the roller pair, e.g., the registration roller pair 40, as a rotary member downstream of the conveyance roller pair 123 and the load torque of the conveyance motor M3 drops in timing of the time t4.

Figure 8A:
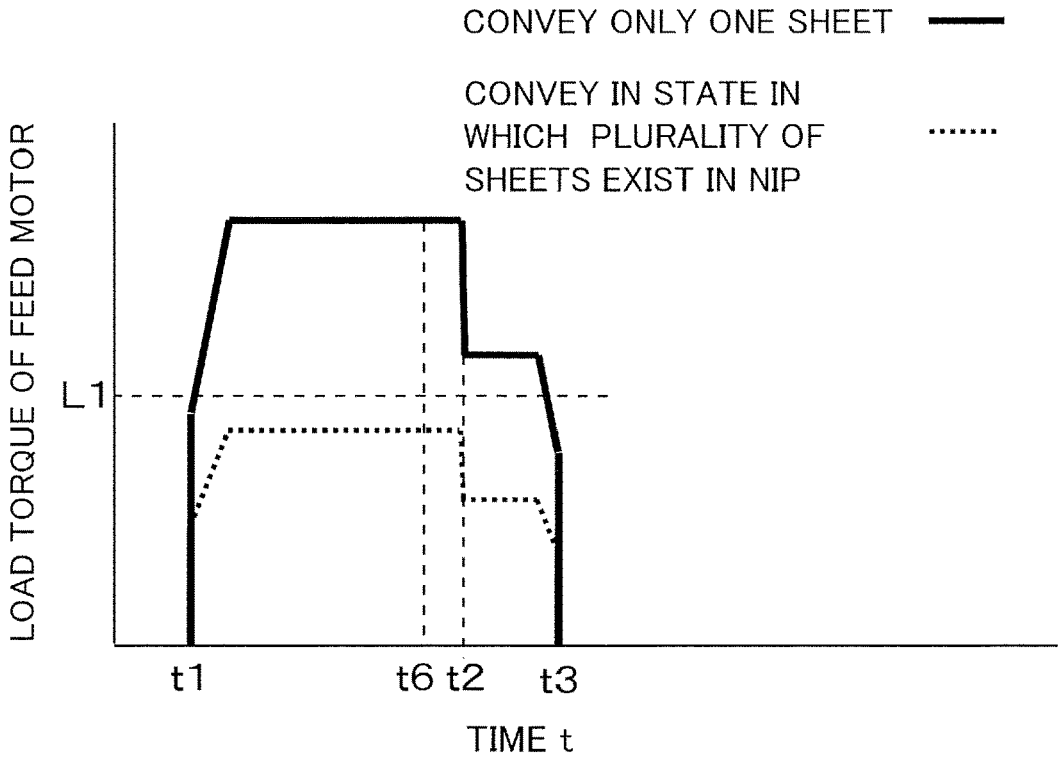
FIG. 8A is a graph indicating a transition of a load torque of the feed motor in a case where a plurality of sheets has entered the separation nip from beginning of feeding.
Figure 8B:
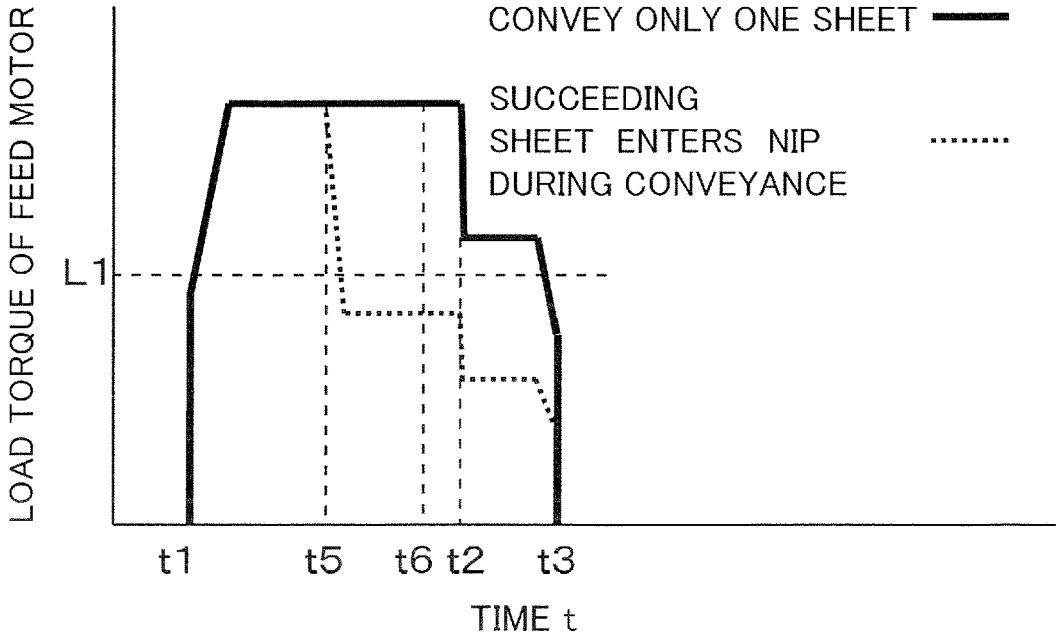
FIG. 8B is a graph indicating a transition of a load torque of the feed motor in a case where a plurality of sheets has entered the separation nip on a way of feeding.

FIGS. 8A and 8B are graphs indicating the load torque of the feed motor M2. It is noted that a solid line in FIGS. 8A and 8B indicates the transition of the load torque of the feed motor M2 in the one-sheet conveyance state. A broken line in FIG. 8A indicates a transition of the load torque of the feed motor M2 in a case where the plurality of sheets has been entered the separation nip 128 already at a moment of time when the sheet feeding operation has been started. Then, when the sheet feeding operation is started in the separation state, the load torque of the feed motor M2 becomes low as compared to the one-sheet conveyance state in an entire range of the time t1 through the time t3 as indicated in FIG. 8A.

A broken line in FIG. 8B indicates a transition of the load torque of the feed motor M2 in a case where the succeeding sheet enters the separation nip 128 after feeding a preceding sheet in the one-sheet conveyance state at a moment of time when the sheet feeding operation is started. When the succeeding sheet enters the separation nip 128 at a time t5, the separation nip 128 becomes the separation state and the load torque of the feed motor M2 thereafter becomes low.

It is thus possible to discriminate whether the conveyance state is the one-sheet conveyance state or the separation state by detecting the load torque of the feed motor M2 at a predetermined timing between the time t5 to the time t3 in any cases of FIGS. 8A and 8B. For instance, it is possible to discriminate the conveyance state to be the one-sheet conveyance state if the load torque of the feed motor M2 at a time t6 right before the time t2 is a threshold value L1 or more and to be the separation state if the load torque of the feed motor M2 is less than the threshold value L1.

Figure 9A:
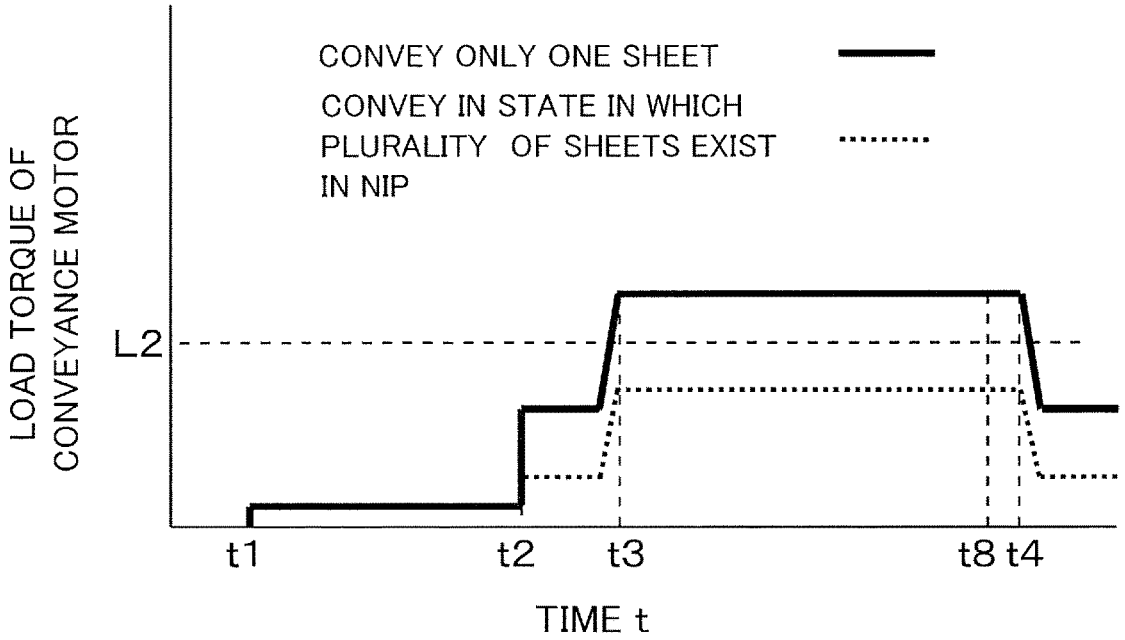
FIG. 9A is a graph indicating a transition of a load torque of the conveyance motor in a case where a plurality of sheets has entered the separation nip from beginning.
Figure 9B:
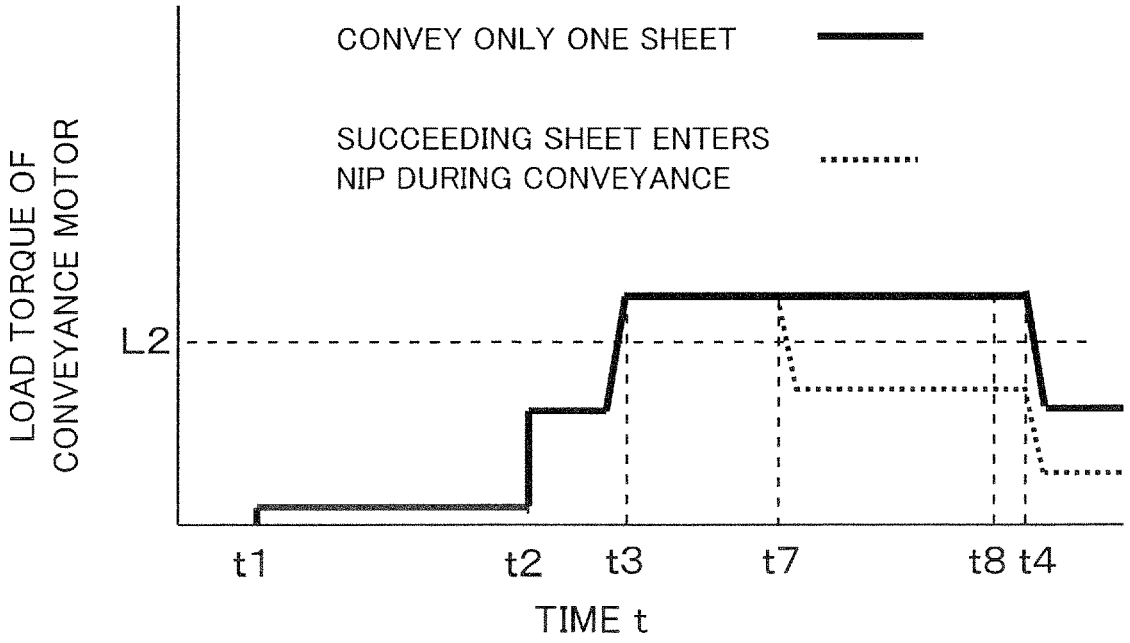
FIG. 9B is a graph indicating a transition of a load torque of the conveyance motor in a case where a plurality of sheets has entered the separation nip on a way.

FIGS. 9A and 9B are graphs indicating a transition of the load torque of the conveyance motor M3. It is noted that a solid line in FIGS. 9A and 9B indicates a transition of the load torque of the conveyance motor M3 in the one-sheet conveyance state. A broken line in FIG. 9A indicates a transition of the load torque of the conveyance motor M3 in a case where the succeeding sheet has entered the separation nip 128 already at a point of time when the leading edge of the preceding sheet has arrived at the conveyance nip 140. Then, if the sheet is conveyed by the conveyance nip 140 when the separation nip 128 is in the separation state, the load torque of the conveyance motor M3 drops in an entire range on and after the time t2 as compared to that in the one-sheet conveyance state as illustrated in FIG. 9A.

A broken line in FIG. 9B indicates a transition of the load torque of the conveyance motor M3 in a case where the conveyance state is the one-sheet conveyance state at a moment of time when the leading edge of the preceding sheet has arrived at the conveyance nip 140 and the succeeding sheet enters the separation nip 128 after that. If the succeeding sheet enters the separation nip 128 at time t7, the separation nip 128 is put into the separation state and the load torque of the conveyance motor M3 after that becomes low.

It is possible to discriminate whether the conveyance state is the one-sheet conveyance state or the separation state by detecting the load torque of the conveyance motor M3 in predetermined timing during the time t7 to the time t4 in any cases of FIGS. 9A and 9B. For instance, it is possible to discriminate the conveyance state to be the one-sheet conveyance state if the load torque of the conveyance motor M3 at time t8 right before the time t4 is a threshold value L2 or more and to be the separation state if the load torque is less than the threshold value L2.

As described above, it is possible to discriminate whether the conveyance state of the separation nip 128 is in the one-sheet conveyance state or in the separation state by detecting at least either load torque of the feed motor M2 or the conveyance motor M3. The feed motor M2 and the conveyance motor M3 are DC motors which are controlled so as to operate with desirable speed by using a speed feedback control in the present embodiment. In this case, a value of current flowing through the motor varies in accordance to a level of the load applied to the motor. The present embodiment utilizes this phenomenon and detects the load torques of the feed motor M2 and the conveyance motor M3 by detecting driving currents of the feed motor M2 and the conveyance motor M3 by the first and second current sensors 132 and 133, respectively (see FIG. 5). It is noted that the first current sensor 132 and the second current sensor 133 may be composed of any current sensors such as an ampere-meter, a multi-meter and a clamp meter. Still further, a stepping motor may be used to decompose the current flowing through the motor to a component generating torque and to a component generating magnetic flux. Then, it is possible to adopt a vector control of independently to independently control the respective currents to detect the load torque from a current value of the torque generating component.

Sheet Feed Control

Figure 10:
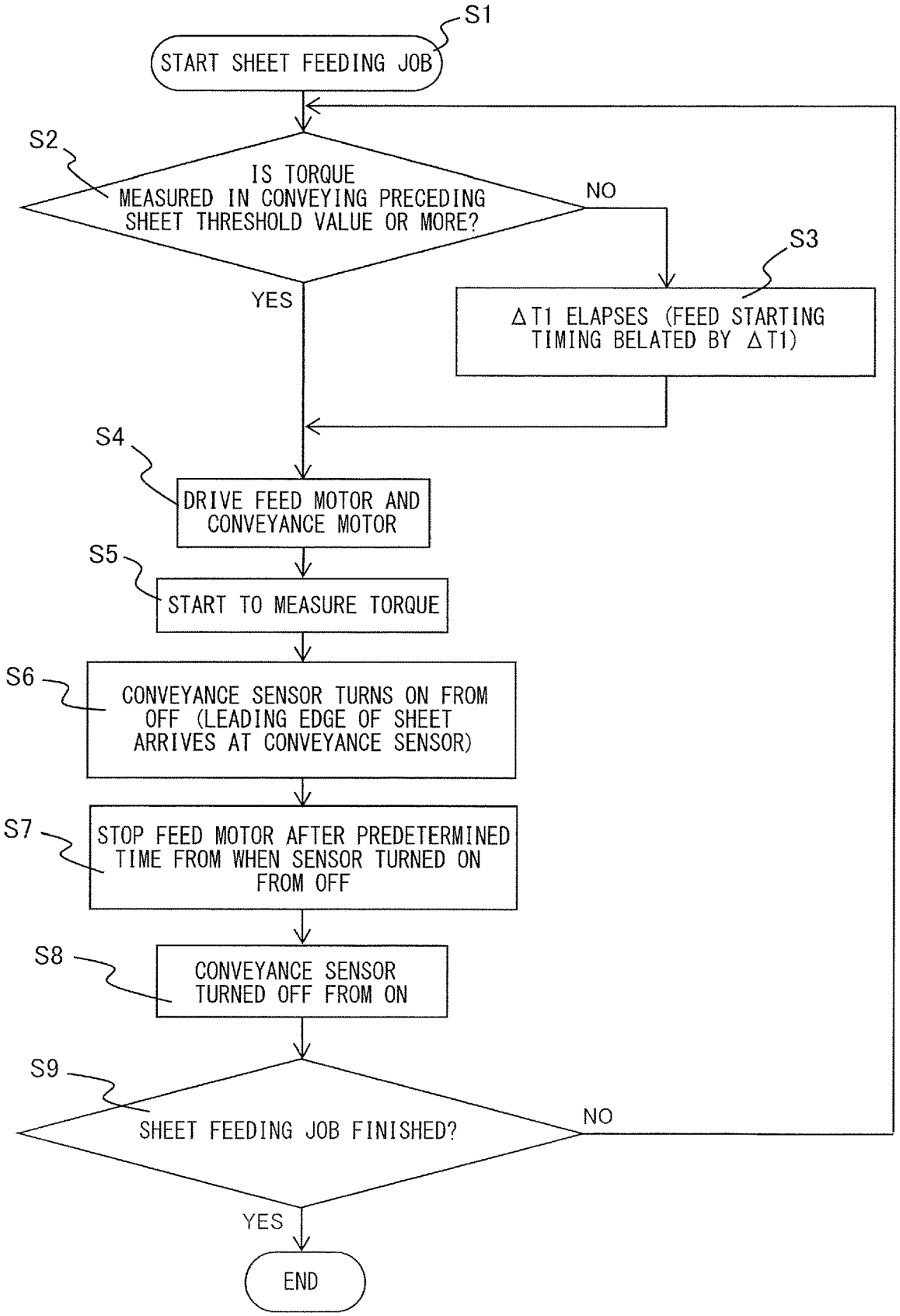
FIG. 10 is a flowchart indicating each process of a sheet feed control.

The sheet feed control of the sheet feed portion 100 of the present embodiment will be described with reference to FIG. 10. When a sheet feeding job is started in Step S1, the control unit 131 discriminates whether a load torque of the feed motor M2 or the conveyance motor M3 measured in conveying a preceding sheet is a threshold value or more in Step S2. For instance, as illustrated in FIGS. 8A and 8B, the control unit 131 discriminates whether the load torque of the feed motor M2 at time t6 is the threshold value L1 or more. Still further, as illustrated in FIGS. 9A and 9B, the control unit 131 discriminates whether the load torque of the conveyance motor M3 at time t8 is a threshold value L2 or more. It is noted that in a case where a first sheet is fed in the sheet feeding job, the process advances to Step S4 by skipping Step S2.

In a case where the load torque of the feed motor M2 or the conveyance motor M3 measured in conveying the preceding sheet is the threshold value or more, i.e., YES in Step S2, the control unit 131 judges that the separation nip 128 has been in the one-sheet conveyance state when the preceding sheet has been conveyed. That is, a leading edge of a succeeding sheet has not passed through the separation nip 128 in starting a feeding operation of the succeeding sheet, and the control unit 131 drives the feed motor M2 and the conveyance motor M3 at normal timing in Step S4. That is, the control unit 131 executes the feeding operation of the succeeding sheet with the normal timing of a first feed timing. Here, a time interval from starting to feed the preceding sheet until starting to feed the succeeding sheet will be defined as a feeding interval. Then, a feeding interval when the feeding operation of the succeeding sheet is executed with the normal timing will be called as a first feeding interval. A sheet interval between the preceding sheet and the succeeding sheet is determined by appropriately setting the feeding interval.

Figure 11:
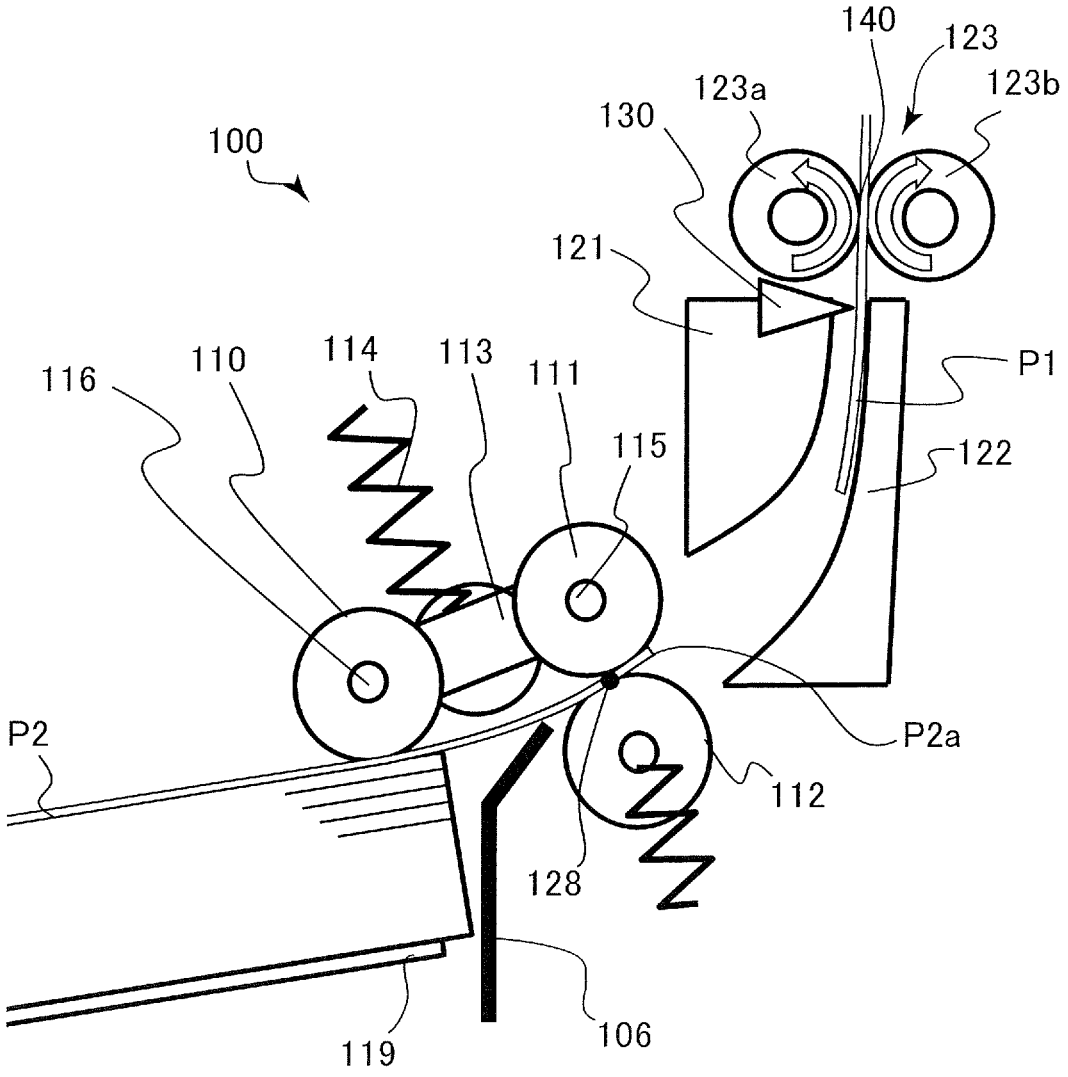
FIG. 11 is a side view illustrating a feed portion in a state in which a leading edge of a succeeding sheet passes through the separation nip in starting to feed a sheet.

Meanwhile, in a case whether the load torque of the feed motor M2 or the conveyance motor M3 measured in conveying the preceding sheet is less than the threshold value, i.e., NO in Step S2, the control unit 131 judges that the separation nip 128 has been in the separation state in conveying the preceding sheet. That is, as illustrated in FIG. 11, a leading edge P2*a* of the succeeding sheet P2 has passed through the separation nip 128 in starting a feeding operation of the succeeding sheet P2. If the feeding operation of the succeeding sheet P2 is started in this state, there is a possibility that a sheet interval with the preceding sheet P1, i.e., the first sheet, cannot be enough depending on a jump-out amount of the leading edge P2*a* of the succeeding sheet P2 out of the separation nip 128. The sheet interval has been set widely in the past by anticipating also this jump-out amount.

According to the present embodiment, in a case where the load torque of the feed motor M2 or the conveyance motor M3 in conveying the preceding sheet P1 is less than the threshold value, i.e., NO in Step S2, the starting timing of the feeding operation of the succeeding sheet P2 is belated by Δt1 from the normal timing in Step S3. Then, the control unit 131 drives the feed motor M2 and the conveyance motor M3 with second feed timing which is belated by Δt1 from the normal timing in Step S4 and starts to measure the load torques of the feed motor M2 and the conveyance motor M3 during the drive in Step S5. The feeding interval in the case where the feed starting timing of the succeeding sheet is belated by Δt1 from the normal timing will be called as a second feeding interval. That is, the second feeding interval is longer than the first feeding interval, and drive starting timing of the feed motor M2 and the conveyance motor M3 is belated in the case of the control under the second feeding interval as compared to the case of the control under the first feeding interval.

The control unit 131 stops to drive the feed motor M2 after a predetermined time from when the conveyance sensor 130 which has been changed to be ON from OFF, i.e., at the time t3 in FIG. 7 in Steps S6 and S7. Still further, when the conveyance sensor 130 changes to OFF from ON in Step S8, the control unit 131 judges whether the sheet feeding job has finished in Step S9. In a case where the control unit 131 judges that the sheet feeding job is not finished, i.e., No in Step S9, the control unit 131 repeats the processes of Step S2 to Step S8 and finishes the sheet feed control when the control unit 131 judges that the sheet feeding is finished, i.e., YES in Step S9.

If a value of Δt1 in Step S3 is too large, there is a possibility that it is unable to convey a sheet to the secondary transfer portion TP2 at desirable timing. Accordingly, Δt1 is set within a rage range by which the sheet can arrive at the secondary transfer portion TP2 with desirable timing. Still further, while the position of the leading edge P2*a* of the succeeding sheet P2 in starting the feeding operation in the separation state varies more or less between the separation nip 128 and the conveyance sensor 130, the registration roller pair 40 absorbs this variation.

Because the starting timing of the feeding operation of the sheet is changed by measuring whether the leading edge of the sheet exceeds the separation nip 128 while feeding the sheet as described above, it is possible to reduce the margin of the sheet interval between the preceding sheet and the succeeding sheet and to shorten the sheet interval. Due to that, it is possible to improve productivity while keeping the sheet conveyance speed. Or, it is possible to reduce the sheet conveyance speed and to reduce noise of the apparatus while keeping the productivity.

It is possible to reduce the margin set in the sheet interval such that a position of the leading edge of the sheet to be fed can be accurately determined. While the conveyance state of the separation nip 128 is determined by detecting the load torque of the feed motor M2 or the conveyance motor M3 in the present embodiment, its accuracy depends on a nip width of the separation nip 128 in the conveyance direction. The nip width of the separation nip 128 is about 2 mm or less, though it depends also on hardness of the roller. Due to that, as compared to a flag sensor using a flag that turns by being pressed by a leading edge of a sheet for example, the position of the leading edge of the sheet to be fed can be accurately determined in the present embodiment.

Still further, it is necessary to provide the flag sensor at a widthwise center part of the conveyance path in order to prevent the sheet from being obliquely conveyed. Thus, a degree of freedom of disposition of the flag sensor is low, becoming a factor of enlarging an apparatus. Meanwhile, according to the present embodiment, it is not necessary to provide the current sensor detecting the load torque of the feed motor M2 or the conveyance motor M3 within the conveyance path and its degree of freedom of disposition is high.

Second Embodiment

Next, while a second embodiment of the present disclosure will be described, the second embodiment is what a threshold value of the load torque of the first embodiment is appropriately updated. Accordingly, the same components with those of the first embodiment will not be illustrated or will be described by denoting the same reference numerals in the drawings.

While the threshold value of the load torque for discriminating the conveyance state of the separation nip 128 whether it is the one-sheet conveyance state or the separation state may be set as a fixed value in advance, variation of the conveyance load caused by a type and size of the sheet disregarded in such a case. That is, there is a case where the resistant force Fg generated by the friction between the sheet and the inner guide 121 and the outer guide 122, and it is necessary to prepare a threshold value of a load torque per type and size of the sheet to be fed. Still further, a sliding load of a driving system may change as the feeding operation of the sheet feed portion 100 is continued. Because there is a possibility that it becomes difficult to discriminate the conveyance state of the separation nip 128 if the threshold value is set as a fixed value as described above, it is desirable to correct the threshold value appropriately.

Figure 12:
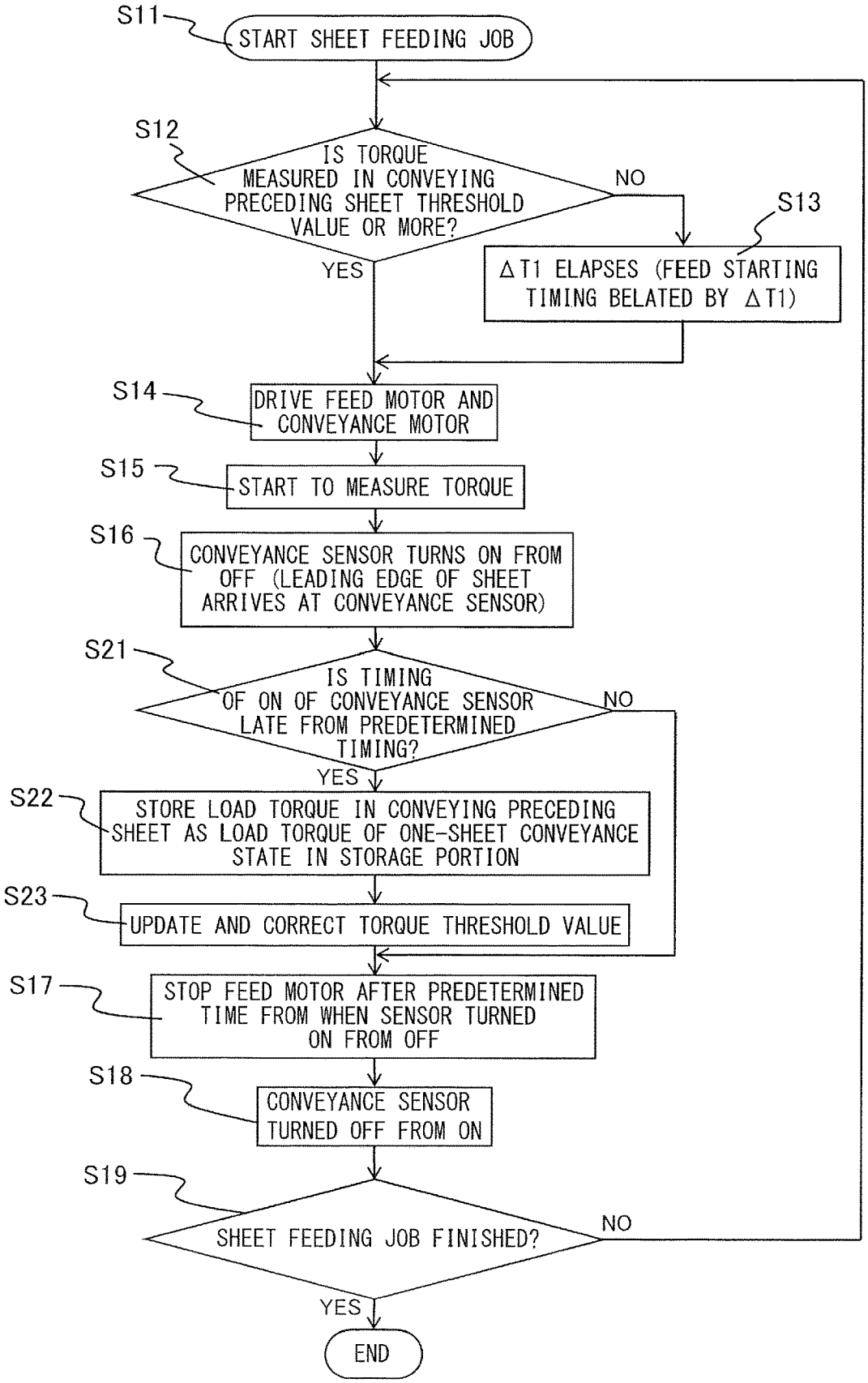
FIG. 12 is a flowchart indicating each process of a sheet feed control of a second embodiment.

FIG. 12 is a flowchart indicating processes of a sheet feed control in which a threshold value is to be corrected. It is noted that because Steps S11 through S19 in FIG. 12 are same with Steps S1 through S9 in FIG. 10, their descriptions will be omitted here. As illustrated in FIG. 12, the control unit 131 judges whether timing when the conveyance sensor 130 is turned ON after the process of Step S16 is late as compared to the predetermined timing in Step S21.

That is, as illustrated in FIG. 11, in the case where the leading edge of the succeeding sheet P2 has passed through the separation nip 128 in starting to feed the succeeding sheet P2, the timing when the conveyance sensor 130 is turned ON is earlier as compared to a case where a sheet is conveyed from the cassette 106. Therefore, it can be seen that the separation nip 128 has been in the separation state while feeding the preceding sheet P1 if the conveyance sensor 130 has been turned ON earlier than the predetermined timing. Still further, if the conveyance sensor 130 is turned ON earlier than the predetermined timing, it can be seen that the separation nip 128 has been the one-sheet conveyance state while feeding the preceding sheet P1.

Therefore, in a case where the timing when the conveyance sensor 130 is turned ON is late as compared to the predetermined timing, i.e., YES in Step S21, the control unit 131 stores the load torque in conveying the preceding sheet P1 as a load torque of the one-sheet conveyance state in the storage portion 134 (see FIG. 5). Then, the control unit 131 updates and corrects the threshold value based on the load torque stored in the storage portion 134 in Step S23. For instance, the control unit 131 sets a value obtained by subtracting a certain value from an average value of the load torques of 10 one-sheet conveyance states stored in the storage portion 134 as a new threshold value. In a case where the timing when the conveyance sensor 130 is turned ON is earlier than the predetermined timing, i.e., No in Step S21, or the process of Step S23 is finished, the process advances to Step S17.

As described above, it is possible to discriminate the conveyance state of the separation nip 128 accurately without being affected by the type and size of the sheet and changes of the sliding load of the driving system and others by appropriately updating the threshold value of the load torque of the motor. This arrangement makes it possible to detect the position of the leading edge of the sheet to be fed in high precision and to shorten the sheet interval.

It is noted that while the threshold value has been updated and corrected by using the load torque of the one-sheet conveyance state in the present embodiment, the present disclosure is not limited to such arrangement. For instance, a load torque in a separation state may be stored and a value in which a certain value is added to that may be set as a new threshold value.

Third Embodiment

Next, while a third embodiment of the present disclosure will be described, the third embodiment is what a part of the sheet feed control of the first embodiment is modified. Accordingly, the same components with those of the first embodiment will not be illustrated or will be described by denoting the same reference numerals.

Figure 13A:
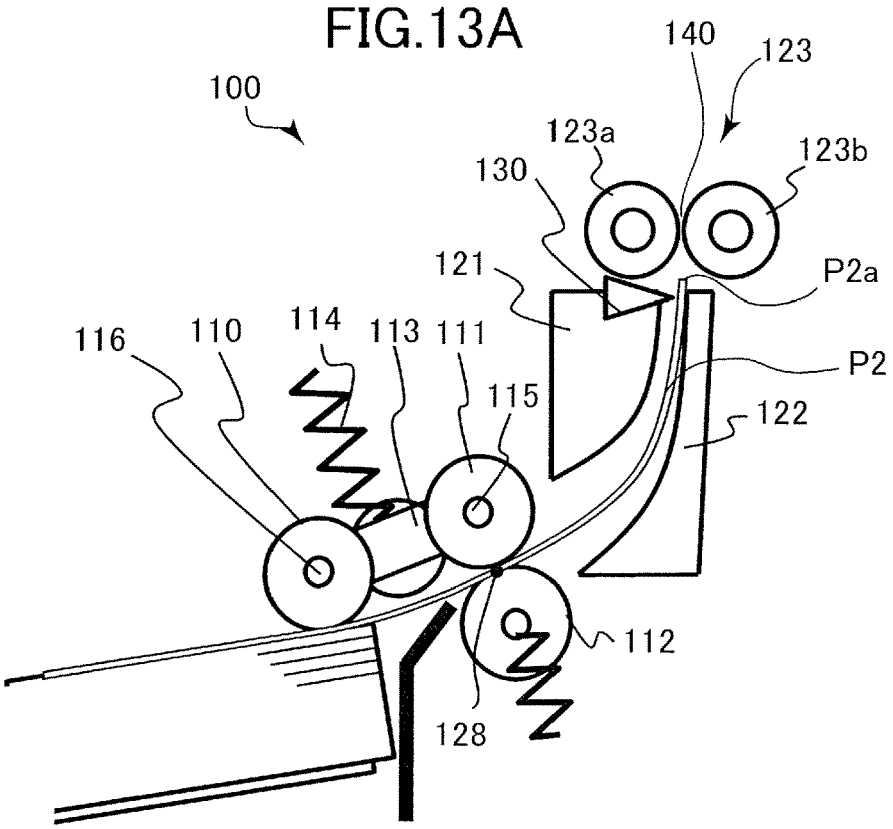
FIG. 13A is a side view illustrating the feed portion in a state in which a succeeding sheet has been considerably fed following a preceding sheet in a third embodiment.
Figure 13B:
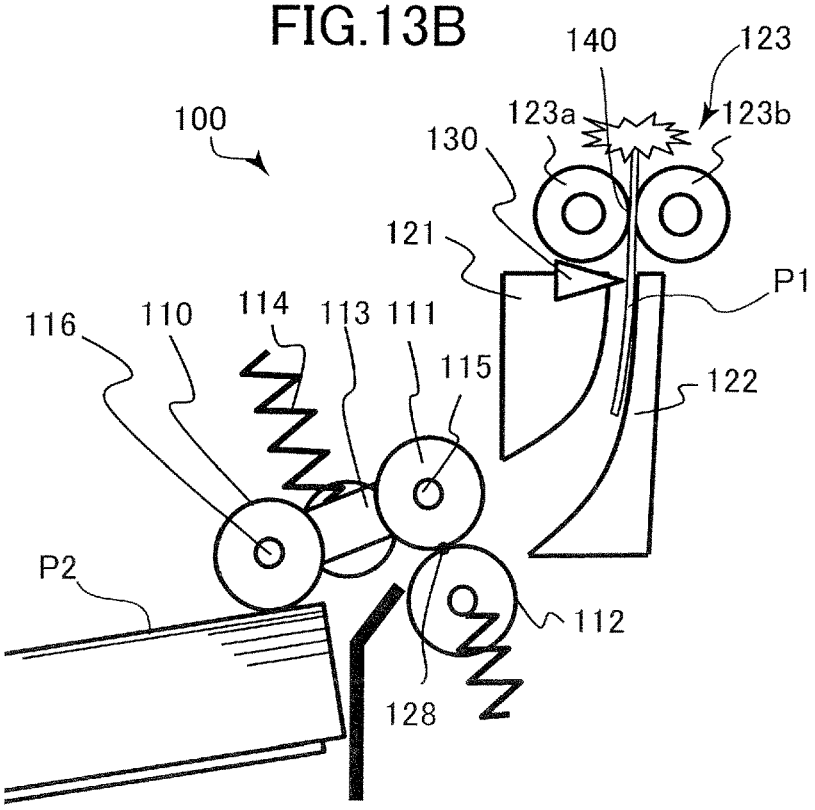
FIG. 13B is a side view illustrating the feed portion in a state in which a succeeding sheet is jammed.

In a case where the conveyance sensor 130 is ON before starting the feeding operation of the succeeding sheet P2, states of the following two patterns are conceivable. One pattern is a case where the succeeding sheet P2 is considerably fed following the preceding sheet P1 while feeding the preceding sheet P1 and the conveyance sensor 130 detects the succeeding sheet P2 as illustrated in FIG. 13A. The other pattern is a case where a jam is occurring while feeding the preceding sheet P1 and the conveyance sensor 130 detects the jammed preceding sheet P1 as illustrated in FIG. 13B. While it is unknown which state is occurring among the states described above only by information of the conveyance sensor 130, it is possible to discriminate which state is occurring by detecting the load torque of the feed motor M2 or the conveyance motor M3.

Figure 14:
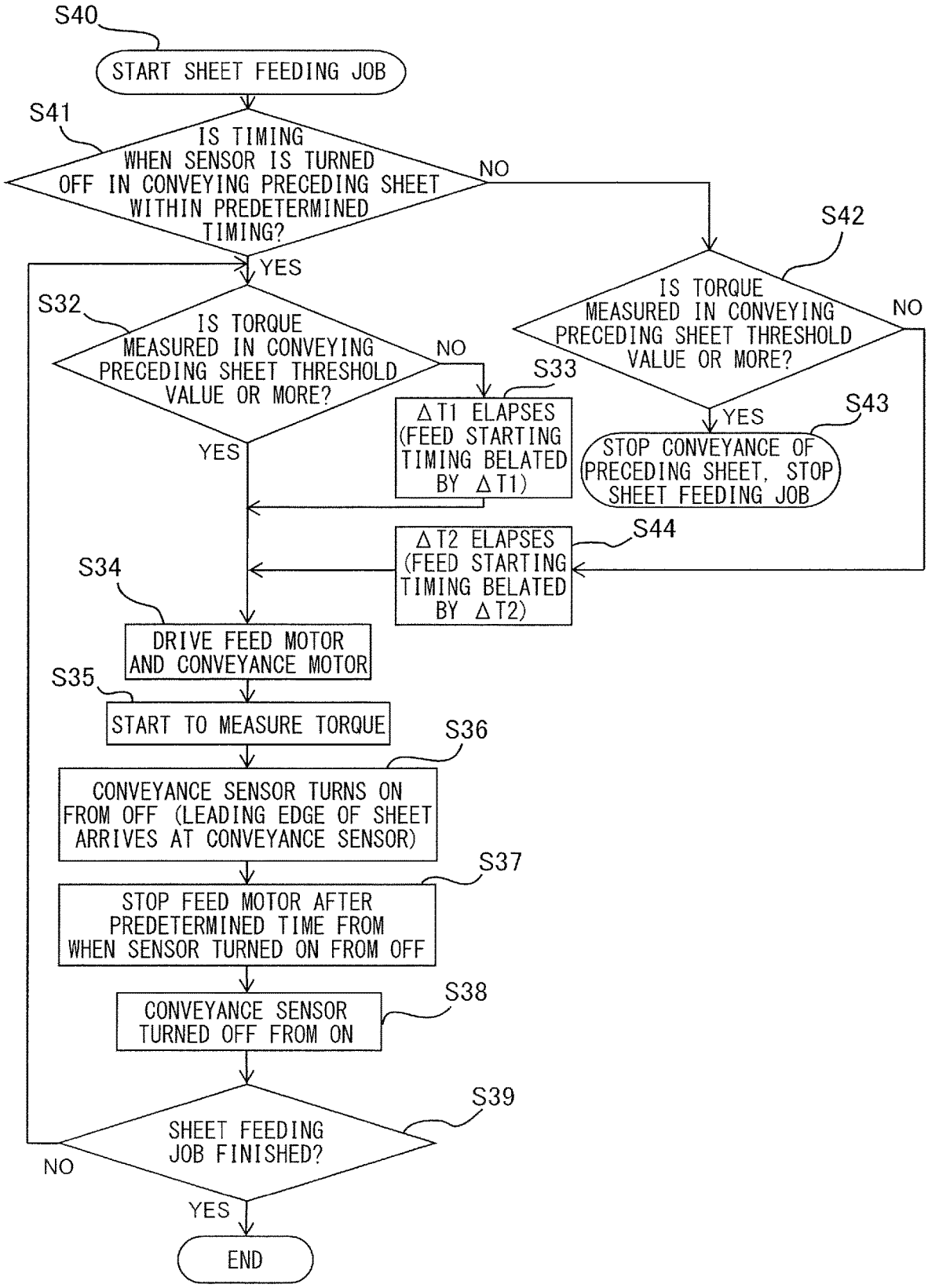
FIG. 14 is a flowchart indicating each process of a sheet feed control of the third embodiment.

A sheet feed control of the sheet feed portion 100 of the present embodiment will be described with reference to a flowchart in FIG. 14. When a sheet feeding job is started as indicated in Step S40 in FIG. 14, the control unit 131 judges whether timing when the conveyance sensor 130 is turned OFF from ON is earlier than the predetermined timing in conveying the preceding sheet P1 in Step S41. In a case where the timing when the conveyance sensor 130 is turned OFF is earlier than the predetermined timing, i.e., YES in Step S41, the process advances to Step S32. Processes in Step S32 through Step S39 are same with those of Step S2 through Step S9 in FIG. 10, so that a description thereof will be omitted here.

In a case where the timing when the conveyance sensor 130 is turned OFF is late as compared to the predetermined timing, i.e., NO in Step S41, the control unit 131 determines whether the load torque measured in conveying the preceding sheet P1 is the threshold value or more in Step S42. For instance, as illustrated in FIGS. 8A and 8B, the control unit 131 determines whether the load torque of the feed motor M2 at the time t6 is the threshold value L1 or more. Still further, as illustrated in FIGS. 9A and 9B for instance, the control unit 131 determines whether the load torque of the conveyance motor M3 at the time t8 is the threshold value L2 or more.

In a case where the load torque of the feed motor M2 or the conveyance motor M3 measured in conveying the preceding sheet P1 is the threshold value or more, i.e., YES in Step S42, the succeeding sheet P2 has not arrived at the separation nip 128, so that the preceding sheet P1 is jammed as illustrated in FIG. 13B. Due to that, the control unit 131 halts the feeding operation of the preceding sheet P1 and stops the sheet feeding job in Step S43. This arrangement makes it possible to prevent parts of the driving system from being overloaded and a sheet from slipping into a gap within the apparatus.

In a case where the load torque of the feed motor M2 or the conveyance motor M3 measured in conveying the preceding sheet P1 is less than the threshold value, i.e., NO in Step S42, the succeeding sheet P2 has arrived at the separation nip 128, so that the succeeding sheet P2 is fed following the preceding sheet as illustrated in FIG. 13A. Due to that, the control unit 131 delays the starting timing of the feeding operation of the succeeding sheet P2 by Δt2 from the normal timing in Step S44. Then, the control unit 131 starts the feeding operation of the succeeding sheet P2 with a third feed timing which is late by Δt2 from the normal timing in Step S34. A feeding interval in the case where the feed starting timing of the succeeding sheet is set to be late by Δt2 will be called as a third feeding interval. That is, the third feeding interval is longer than the second feeding interval. This arrangement makes it possible to prevent a sheet from jamming even if the succeeding sheet P2 is fed from a state in which the succeeding sheet P2 has passed through the separation nip 128 considerably. It is noted that because a jump-out amount of the leading edge P2*a* of the succeeding sheet P2 out of the separation nip 128 is greater than the case illustrated in FIG. 11, a value of Δt2 is set to be larger than the value of Δt1, i.e., Δt2>Δt1

It is possible to discriminate whether the preceding sheet P1 is jamming or the succeeding sheet P2 is considerably fed following the preceding sheet by combining the information of the conveyance sensor 130 with the information on the load torque of the feed motor M2 or the conveyance motor M3 as described above. Then, it is possible to prevent a sheet from jamming or from damaging the parts by changing the control in accordance to this discrimination result.

Figure 15:
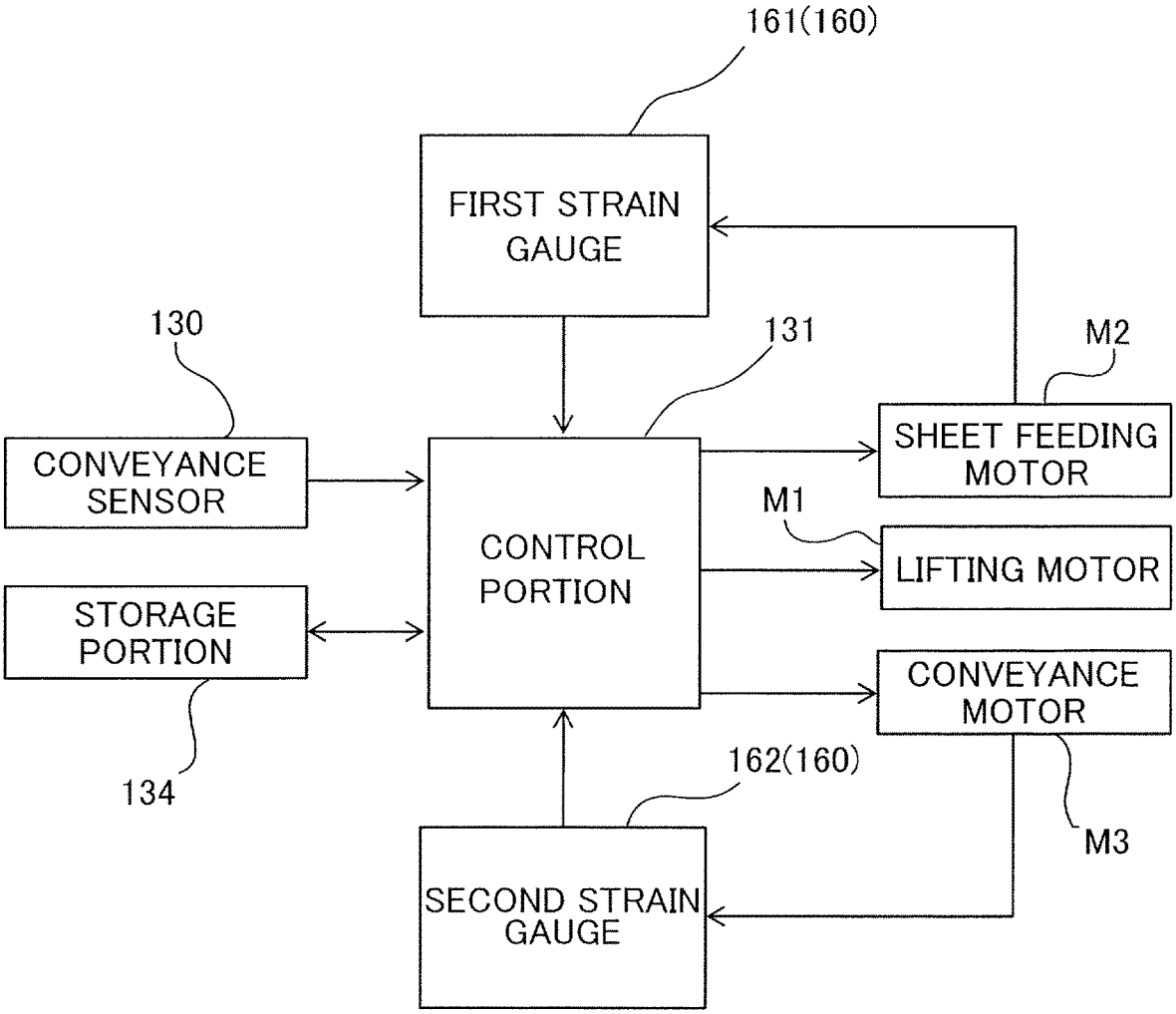
FIG. 15 is a block diagram of a control unit of another embodiment.

It is noted that while both the first and second current sensors 132 and 133 are provided in all of the embodiments described above, at least either one of the first and second current sensors 132 and 133 may be provided. Still further, while the load torques of the feed motor M2 and the conveyance motor M3 are detected based on current values detected by the first current sensor 132 and the second current sensor 133, respectively, the present disclosure is not limited to such arrangement. For instance, a torque sensor in which a first strain gauge 161 is mounted may be attached to the feed roller shaft 115 to detect the load torque of the feed roller 111 by voltage outputted from the torque sensor as illustrated in FIG. 15. In the same manner, a torque sensor in which a second strain gauge 162 is mounted may be attached to the rotary shaft 123*c* (see FIG. 3) of the driving roller 123*a* of the conveyance roller pair 123 to detect the load torque of the conveyance roller pair 123. These first and second strain gauges 161 and 162 compose a load detecting unit 160. The greater the strain of the feed roller shaft 115 and the rotary shaft 123*c* or the greater the voltage outputted from the first and second strain gauges 161 and 162, the greater the conveyance load acting on the sheet feed portion 100 is.

Still further, while the sheet stacked on the sheet supporting plate 119 is fed by the pickup roller 110 in all of the embodiments described above, the present disclosure is not limited to such arrangement. For instance, the pickup roller 110 may be omitted, and the sheet stacked on the sheet supporting plate 119 may be fed by the feed roller 111. It is also arbitral to set the current values measured by the first and second current sensors 132 and 133 and the threshold value to be set to be either a plus value or a minus value in an inner process of the control unit 131. While these current values and the threshold values have been set to be plus values in all of the embodiments described above, the expressions of "more than" and "less than" of the determination of the threshold values in the flowcharts described above are inverted in a case where these values are minus values.

Figure 16:
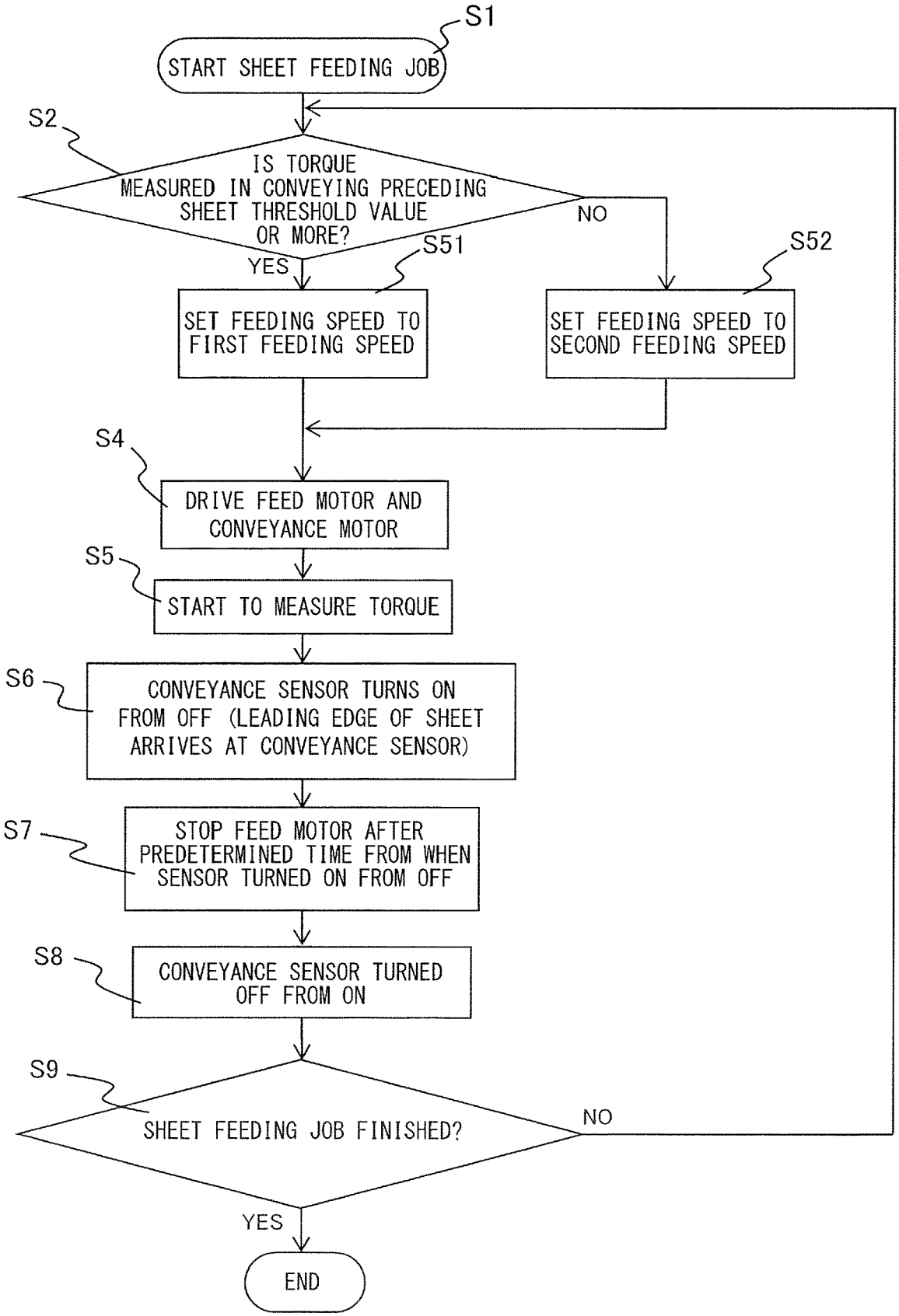
FIG. 16 is a flowchart indicating each process of a sheet feed control of the other embodiment.

Still further, while the starting timing of the feeding operation is belated in the case where the leading edge of the succeeding sheet P2 exceeds the separation nip 128 in starting to feed the succeeding sheet in all of the embodiments described above, another method may be used if the sheet interval becomes an appropriate value. For instance, the sheet feed control may be executed based on a flowchart as illustrated in FIG. 16. Steps S1, S2, S4 through S9 are same with the respective steps in the flowchart in FIG. 10, so that their description will be omitted here. In a case where the load torque of the feed motor M2 or the conveyance motor M3 measured in conveying a preceding sheet is a threshold value or more, i.e., YES in Step S2, the control unit 131 judges that the separation nip 128 has been in the one-sheet conveyance state in conveying the preceding sheet. Then, the control unit 131 sets a feeding speed to a first feeding speed. Then, the control unit 131 sets the feeding speed to a second feeding speed which is slower than the first feeding speed in Step S52. After that, the sheet feed portion 100 feeds a sheet with the feeding speed set as described above in Step S4. It is noted that the feeding speed is changed by changing driving speed of at least either the feed motor M2 or the conveyance motor M3. Still further, the starting timing of the feeding operation is unchanged in the one-sheet conveyance state and the separation state in the sheet feed control based on the flowchart in FIG. 16. Thus, the control unit 131 may execute the feeding operation to the succeeding sheet with the first feeding speed or the second feeding speed in response to the load when the preceding sheet has been fed.

Still further, although all of the embodiments described above have been described by using the electrophotographic printer 1, the present disclosure is not limited such case. For instance, the present disclosure is also applicable to an ink-jet type image forming apparatus configured to form an image on a sheet by discharging ink droplets from nozzles.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-205560, filed Oct. 24, 2017, which is hereby incorporated by reference herein in its entirety.

What is claimed is:

1. A sheet feeding apparatus, comprising:

a sheet stacking portion on which a sheet is stacked;

a sheet feeding unit comprising a rotary feeding member configured to come in to contact with the sheet and to rotate, and a separation member configured to define a nip portion together with the rotary feeding member, the nip portion separating the sheet fed by the rotary feeding member from another sheet;

a load detecting unit configured to detect a conveyance load acting on the sheet feeding unit while feeding the sheet by the sheet feeding unit; and a control unit configured to control the sheet feeding unit such that the sheet feeding unit starts to feed a second sheet succeeding to a first sheet at a first timing in a case where the conveyance load detected by the load detecting unit while feeding the first sheet is less than a threshold value, and starts to feed the second sheet at a second timing which is later than the first timing in a case where the conveyance load detected by the load detecting unit while feeding the first sheet exceeds the threshold value.

2. The sheet feeding apparatus according to claim 1, wherein the control unit sets the threshold value based on the conveyance load detected by the load detecting unit while feeding the first sheet.

3. The sheet feeding apparatus according to claim 2, further comprising a sheet detecting unit disposed downstream of the nip portion in a sheet feeding direction and configured to detect a position of the sheet being conveyed, wherein the control unit sets the threshold value based on the conveyance load detected by the load detecting unit while feeding the first sheet in a case where the sheet detecting unit detects the second sheet with timing belated from a predetermined timing.

4. The sheet feeding apparatus according to claim 1, further comprising a sheet detecting unit disposed downstream of the nip portion in a sheet feeding direction and configured to detect a leading edge and a trailing edge of the sheet being conveyed, wherein the control unit controls the sheet feeding unit such that the sheet feeding unit starts to feed the second sheet at the second timing in a case where timing in which a trailing edge of the first sheet is detected by the sheet detecting unit is earlier than a predetermined timing and where the conveyance load detected by the load detecting unit while feeding the first sheet exceeds the threshold value, the sheet feeding unit starts to feed the second sheet at the second timing in a case where timing in which a trailing edge of the first sheet is detected by the sheet detecting unit is earlier than the predetermined timing and where the conveyance load detected by the load detecting unit while feeding the first sheet is less than the threshold value, and the sheet feeding unit starts to feed the second sheet at a third timing which is later than the second timing in a case where timing in which a trailing edge of the first sheet is detected by the sheet detecting unit after the predetermined timing and where the conveyance load detected by the load detecting unit while feeding the first sheet is less than the threshold value.

5. The sheet feeding apparatus according to claim 4, wherein the control unit stops feeding the first sheet in a case where a trailing edge of the first sheet is not detected by the sheet detecting unit by the predetermined timing and where the conveyance load detected by the load detecting unit while feeding the first sheet exceeds the threshold value.

6. The sheet feeding apparatus according to claim 1, further comprising:

a rotary conveyance member disposed downstream of the rotary feeding member in a sheet feeding direction and configured to convey the sheet that has passed through the nip portion; and a first driving source configured to drive the rotary feeding member, wherein the load detecting unit comprises a first current sensor configured to detect a current flowing through the first driving source and is configured to detect the conveyance load based on a detection result of the first current sensor, and the conveyance load is larger as a current flowing detected by the first current sensor increases.

7. The sheet feeding apparatus according to claim 6, wherein the first current sensor is configured to detect a current flowing through the first driving source right before the first sheet arrives at the rotary conveyance member.

8. The sheet feeding apparatus according to claim 1, further comprising:

a rotary conveyance member disposed downstream of the rotary feeding member in a sheet feeding direction and configured to convey the sheet that has passed through the nip portion; and a second driving source configured to drive the rotary conveyance member, wherein the load detecting unit comprises a second current sensor detecting a current flowing through the second driving source and detects the conveyance load based on a detection result of the second current sensor, and the conveyance load is larger as a current flowing detected by the second current sensor increases.

9. The sheet feeding apparatus according to claim 8, wherein the second current sensor is configured to detect a current flowing through the second driving source right before the first sheet arrives at a rotary member provided downstream of the rotary conveyance member in the sheet feeding direction.

10. The sheet feeding apparatus according to claim 1, further comprising a first rotary shaft rotatably supporting the rotary feeding member, wherein the load detecting unit comprises a first strain gauge configured to detect strain of the first rotary shaft and is configured to detect the conveyance load based on a detection result of the first strain gauge, and the conveyance load is larger as the strain detected by the first strain gauge increases.

11. The sheet feeding apparatus according to claim 10, further comprising:

a rotary conveyance member disposed downstream of the rotary feeding member in a sheet feeding direction and configured to convey the sheet that has passed through the nip portion; and a second rotary shaft rotatably supporting the rotary conveyance member, wherein the load detecting unit comprises a second strain gauge configured to detect strain of the second rotary shaft and is configured to detect the conveyance load based on a detection result of the second strain gauge, and the conveyance load is larger as the strain detected by the second strain gauge increases.

12. The sheet feeding apparatus according to claim 1, further comprising an upstream rotary member disposed upstream of the rotary feeding member in a sheet feeding direction and configured to feed the sheet by being in contact with the sheet stacked on the sheet stacking portion.

13. An image forming apparatus, comprising:

a sheet stacking portion on which a sheet is stacked;

a sheet feeding unit comprising a rotary feeding member configured to come in to contact with the sheet and to rotate, and a separation member configured to define a nip portion together with the rotary feeding member, the nip portion separating the sheet fed by the rotary feeding member from another sheet;

a load detecting unit configured to detect a conveyance load acting on the sheet feeding unit while feeding the sheet by the sheet feeding unit;

a control unit configured to control the sheet feeding unit such that the sheet feeding unit starts to feed a second sheet succeeding to a first sheet at a first timing in a case where the conveyance load detected by the load detecting unit while feeding the first sheet is less than a threshold value, and starts to feed the second sheet at a second timing which is later than the first timing in a case where the conveyance load detected by the load detecting unit while feeding the first sheet exceeds the threshold value.

* * * * *